US011737636B2

(12) United States Patent
Zhang et al.

(10) Patent No.: US 11,737,636 B2
(45) **Date of Patent: *Aug. 29, 2023**

(54) CLEANING DEVICE

(71) Applicant: SHENZHEN FLY RODENT DYNAMICS INTELLIGENT TECHNOLOGY CO., LTD., Shenzhen (CN)

(72) Inventors: Wuji Zhang, Shenzhen (CN); Quanlong Lu, Shenzhen (CN); Changtai Xia, Shenzhen (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/643,905

(22) Filed: Dec. 13, 2021

(65) Prior Publication Data

US 2022/0192455 A1 Jun. 23, 2022

(30) Foreign Application Priority Data

Dec. 21, 2020 (CN) ..... 202011519329

(51) Int. Cl.
*A47L 11/40* (2006.01)

(52) U.S. Cl.
CPC ..... *A47L 11/4069* (2013.01); *A47L 11/4058* (2013.01); *A47L 11/4066* (2013.01); *A47L 11/4072* (2013.01); *A47L 11/4083* (2013.01)

(58) Field of Classification Search
CPC ..... A47L 11/4069; A47L 11/4058; A47L 11/4066; A47L 11/4072; A47L 11/4083;
(Continued)

(56) References Cited

U.S. PATENT DOCUMENTS 10,292,553 B1 * 5/2019 Ebrahimi Afrouzi ... A47L 7/009
2016/0150934 A1 * 6/2016 Kim ..... A47L 9/0686 15/300.1
2020/0367714 A1 * 11/2020 Wang ..... A47L 11/4011

FOREIGN PATENT DOCUMENTS

CN 206285036 U 6/2017
CN 211324758 U * 8/2020
(Continued)

OTHER PUBLICATIONS

International Search Report for International Application No. PCT/CN2018/101600 dated Mar. 23, 2019.

*Primary Examiner* — David Redding
(74) *Attorney, Agent, or Firm* — Gang Yu

(57) ABSTRACT

The cleaning device includes a main body and at least one drive wheel. The at least one drive wheel is arranged on the main body. The main body can walk on the surface to be cleaned by means of the at least one drive wheel. The cleaning device further includes a driving mechanism, a movable bracket, and a cleaning assembly. The driving mechanism is arranged on the main body, the movable bracket is movably connected to the bottom of the main body, and is connected to the driving mechanism. The movable bracket reciprocates along the direction parallel to the surface to be cleaned under the driving action of the driving mechanism. The cleaning assembly is detachably connected to the movable bracket.

19 Claims, 21 Drawing Sheets

(58) Field of Classification Search
CPC .. A47L 2201/00; A47L 11/284; A47L 11/294; A47L 11/24; A47L 11/4036; A47L 11/4088; A47L 11/4094
See application file for complete search history.

(56) References Cited

FOREIGN PATENT DOCUMENTS

| | | | |
|---|---|---|---|
| CN | 211381118 | U | 9/2020 |
| CN | 212118037 | U | 12/2020 |
| CN | 112716373 | A | 4/2021 |
| WO | 2009119643 | A1 | 10/2009 |
| WO | WO2020037514 | A1 * | 2/2020 |

* cited by examiner

CLEANING DEVICE

CROSS-REFERENCE TO RELATED APPLICATIONS

This application is based upon and claims priority to Chinese Patent Application CN 202011519329.0, filed Dec. 21, 2020, the entire contents of which are incorporated herein by reference.

TECHNICAL FIELD

The present disclosure relates to the field of cleaning devices, and more particularly to a cleaning device.

BACKGROUND

Currently, the cleaning device has a relatively simple cleaning structure, and thus its cleaning capacity is relatively limited. For example, the sweeping and mopping integrated robot only provides a fixed mopping cloth at the bottom of the robot, and the sweeping and mopping integrated robot drives the mop to wipe the floor. However, for relatively tough solid or liquid stains, the above-mentioned cleaning device has a relatively low level of cleanliness to the floor.

SUMMARY

There is provided a cleaning device according to embodiments of the present disclosure. The technical solution is as below:

According to an aspect of embodiments of the present disclosure, there is provided a cleaning device, comprising:

a main body;

at least one drive wheel;

at least one drive wheel arranged on the main body which is capable of moving on a surface to be cleaned by means of the at least one drive wheel;

a driving mechanism arranged on the main body;

a movable bracket movably connected to a bottom of the main body and connected to the driving mechanism, and reciprocating in a direction parallel to the surface to be cleaned under a driving action of the driving mechanism; and a cleaning assembly detachably connected to the movable bracket.

BRIEF DESCRIPTION OF THE DRAWINGS

One or more embodiments are exemplified by the figures in the corresponding drawings. These exemplified descriptions do not constitute a limitation on the embodiments. The elements with the same reference numerals in the drawings are denoted as similar elements. Unless otherwise stated, the figures in the attached drawings do not constitute a scale limitation.

DETAILED DESCRIPTION

In order to make the object, technical solutions, and advantages of the present disclosure clearer, the following description further describes the present disclosure in detail with reference to the accompanying drawings and embodiments. It should be understood that the specific embodiments described herein are only used to explain the present disclosure, but not used to limit the present disclosure. Based on the embodiments of the present disclosure, all other embodiments obtained by those of ordinary skill in the art without creative work shall fall within the protection scope of the present disclosure.

It should be noted that if there is no conflict, the various features in the embodiments of the present disclosure can be combined with each other, and all fall within the protection scope of the present disclosure. In addition, although functional modules are divided in the schematic diagram of the device, and the logical sequence is shown in the flowchart, in some cases, the module division in the device may be different from the module division in the device, or may be different from the steps shown or described in the order in the flowchart. Furthermore, the words "first", "second", "third" and the like used in the present disclosure do not limit the data and execution order, but only distinguish the same or similar items with basically the same function and effect.

The autonomous cleaning devices can be classified into commercial cleaning robots and household cleaning robots according to use, and can be classified into automatic cleaning robots for sweeping, automatic cleaning robots for mopping, automatic cleaning robots for wiping, and automatic cleaning robots for scrubbing.

Figure 1:
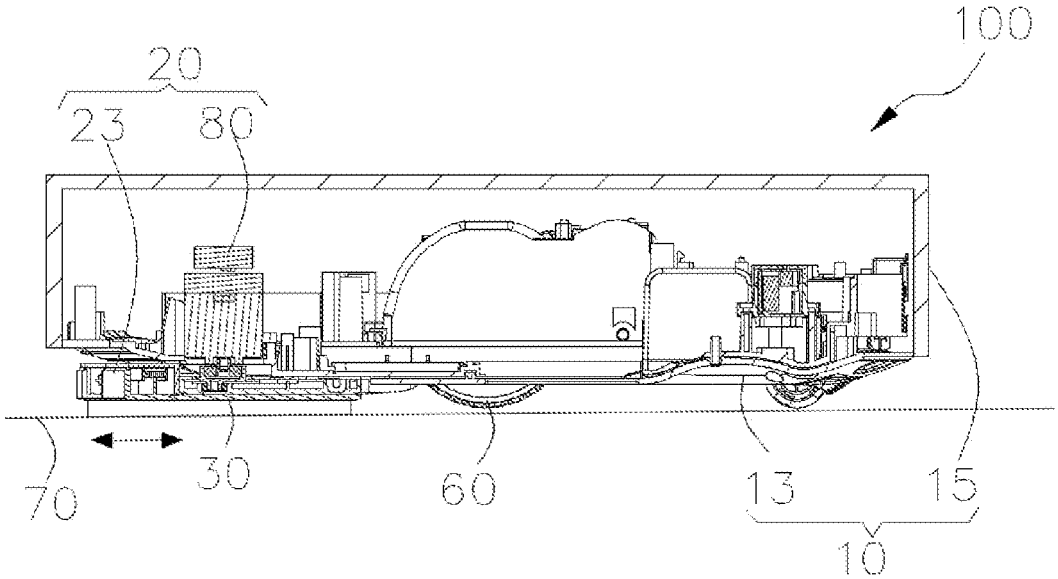
FIG. 1 is a first longitudinal cross-sectional view of a cleaning device provided by an embodiment of the present disclosure.
Figure 2:
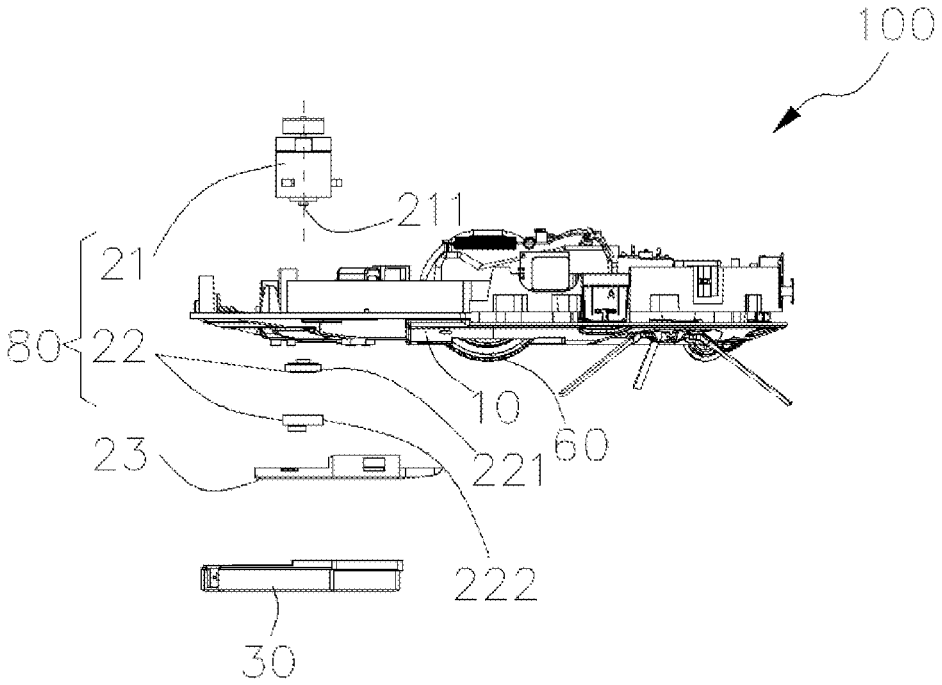
FIG. 2 is a first exploded view of some parts of the cleaning device provided by an embodiment of the present disclosure.
Figure 3:
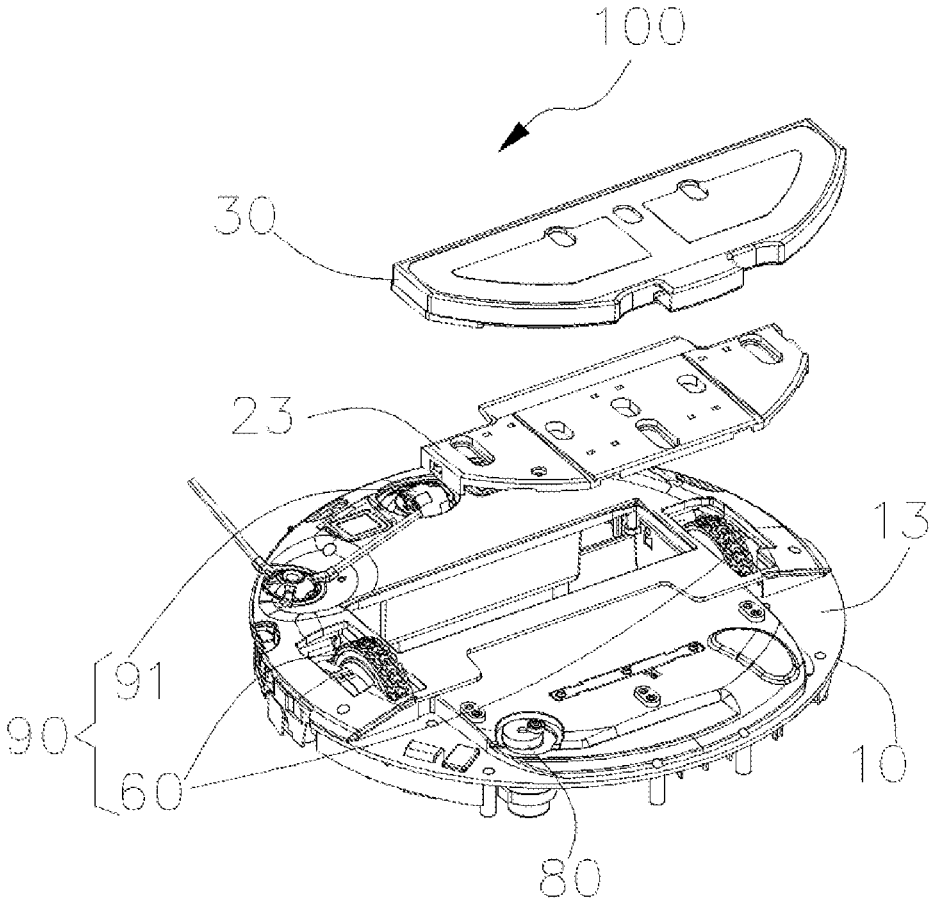
FIG. 3 is a second exploded schematic view of some parts of the cleaning device provided by an embodiment of the present disclosure.

Referring to FIGS. 1-3, an embodiment of the present disclosure provides a cleaning device 100, including a main body 10 and at least one drive wheel 60. The at least one drive wheel 60 is arranged on the main body 10, and the main body 10 is capable of walking on the surface 70 to be cleaned by means of the at least one drive wheel 60. The cleaning device 100 further includes a driving assembly 20 and a cleaning assembly 30. The driving assembly 20 includes a driving mechanism 80 and a movable bracket 23. The driving mechanism 80 is arranged on the main body 10, and the movable bracket 23 is movably connected to the bottom of the main body 10 and connected to the driving mechanism 80. The movable bracket 23 is driven by the driving mechanism 80 to reciprocate in a direction parallel to the surface 70 to be cleaned. The cleaning assembly 30 is detachably connected to the movable bracket 23. The cleaning assembly 30 reciprocates back and forth with the movable bracket 23 to clean the surface 70 to be cleaned.

The driving mechanism 80 includes a driving device 21 and at least one transmission member 22. The driving device 21 is mounted on the main body 10, and the driving device 21 has a driving shaft 211 extending toward the bottom of the main body 10. The movable bracket 23 is movably connected to the bottom of the main body 10, and the movable bracket 23 is spaced from the driving shaft 211. The movement direction of the movable bracket 23 is substantially perpendicular to the extension direction of the driving shaft 211. The movable bracket 23 and the driving shaft 211 are connected by the at least one transmission member 22, and the driving shaft 211 of the driving device 21 drives the movable bracket 23 to reciprocate back and forth through the at least one transmission member 22. The cleaning assembly 30 is detachably connected to the movable bracket 23 so that the cleaning assembly 30 reciprocates back and forth with the movable bracket 23 to clean the surface 70 to be cleaned back and forth.

Different from the traditional technology, the movable bracket 23 of the cleaning device 100 is movably connected to the bottom of the main body 10, and is connected to the driving mechanism 80, so that the driving mechanism 80 can drive the movable bracket 23 through the at least one transmission member to reciprocate back and forth. In addition, the cleaning assembly 30 is detachably connected to the movable bracket 23, and the cleaning assembly 30 can reciprocate back and forth with the movable bracket 23 to clean the surface to be cleaned back and forth. The driving mechanism 80 may provide a sufficient dynamic torque in the reciprocating direction of the movable bracket 23, and may effectively clean tough solid or liquid stains on the floor. Moreover, the cleaning assembly 30 can be disassembled and separated from the movable bracket 23 very conveniently, so that the cleaning device 100 may get rid of the cleaning assembly 30 to perform cleaning in other modes, and has a better obstacle-climbing capability.

It should be understood that the cleaning device 100 may be a hand-held cleaning device 100. For example, the cleaning device 100 may be any one of a hand-held floor scrubbing machine, a hand-held floor scrubbing machine, or a hand-held window cleaning device. The cleaning device 100 may also be an automated cleaning device 100. For example, the cleaning device 100 may be any one of a sweeping robot, a sweeping and mopping integrated robot, a wiping robot, or a scrubbing robot. Of course, the cleaning device 100 may not be limited to the above examples, and those skilled in the art can apply the solution of the present disclosure to a specific cleaning device 100 as needed. The specific implementation of the present disclosure takes a sweeping and mopping integrated robot as an example of the cleaning device 100.

In this embodiment, the cleaning device 100 is a sweeping and mopping integrated robot. The main body 10 is the main part of the cleaning device 100, and the main body 10 may have any shape such as a circle, a rectangle, or a D shape, which is not limited herein. In an alternative embodiment, the main body 10 of the cleaning device 100 may also have other design structures. For example, the main body is an integrally formed structure with a structure separated from left and right. The embodiment of the present disclosure does not limit the material, shape, structure or the like of the body.

The main body 10 may include a chassis 13 and an upper cover assembly 15. The upper cover assembly 15 is detachably mounted on the chassis 13 to protect the various functional components inside the cleaning device 100 from violent impact or accidental dripping of liquid during use. The chassis 13 and/or the upper cover assembly 15 are used to carry and support various functional components. The surface of the upper cover assembly 15 facing away from the chassis 13 forms an appearance surface, which can enhance the overall appearance of the cleaning device 100. The appearance surface can be provided with buttons to facilitate the user to operate the cleaning device 100 through the buttons. An inner cavity is formed between the chassis 13 and the upper cover assembly 15, and the inner cavity is configured to provide an arrangement space for the internal components of the cleaning device 100. The cleaning device 100 may be arranged with a vacuum pump, a circuit board, a floor detection sensor, a collision detection sensor, a wall sensor or the like in the inner cavity.

In the embodiment of the present disclosure, the cleaning device 100 includes a walking mechanism 90 arranged on the chassis 13. The walking mechanism 90 includes two drive wheels 60, at least one universal wheel 91, and a motor for driving the wheels to rotate. The two drive wheels 60 and the at least one universal wheel 91 at least partially protrude from the bottom of the chassis 13. For example, under the action of the weight of the cleaning device 100, the two drive wheels 60 can be partially hidden in the chassis 13. In an optional embodiment, the walking mechanism 90 may further include any one of triangular crawler wheels, Mecanum wheels, and the like. The working mechanism 90 may not include the at least one drive wheel 60.

The cleaning device 100 may be designed to autonomously plan a path on the floor, or may be designed to move on the floor in response to a remote control command. The cleaning device 100 can be navigated by one or a combination of a gyroscope, an accelerometer, a camera, GPS positioning, and/or a lidar. For example, the cleaning device 100 can be provided with a lidar protruding from the top surface, and scan the surrounding environment through lidar to collect obstacle data, build an environment map based on the obstacle data, and perform real-time positioning based on the environment map, which is convenient for planning a path to be clean.

The cleaning device 100 may include at least one middle sweeping brush, and the at least one middle sweeping brush may be arranged in an accommodating groove recessed at the bottom of the chassis 13, and a dust suction port is positioned in the accommodating groove. The dust suction port communicates with the dust collection box and the dust suction fan, so that when the middle sweeping brush rotates, the dust and garbage on the floor are stirred up, and then sucked into the dust collection box through the dust suction port under a suction force of the suction fan.

The cleaning device 100 includes a water tank, and the liquid in the water tank can be transported to the cleaning assembly 30 through a peristaltic pump and a tube to wet the cleaning assembly 30, so that the cleaning assembly 30 can wet the floor, thereby facilitating the removal of dirt on the floor when the cleaning assembly 30 reciprocates, and improving the cleaning effect. In other embodiments, the liquid in the water tank can also penetrate into the cleaning assembly 30 by gravity.

Figure 4:
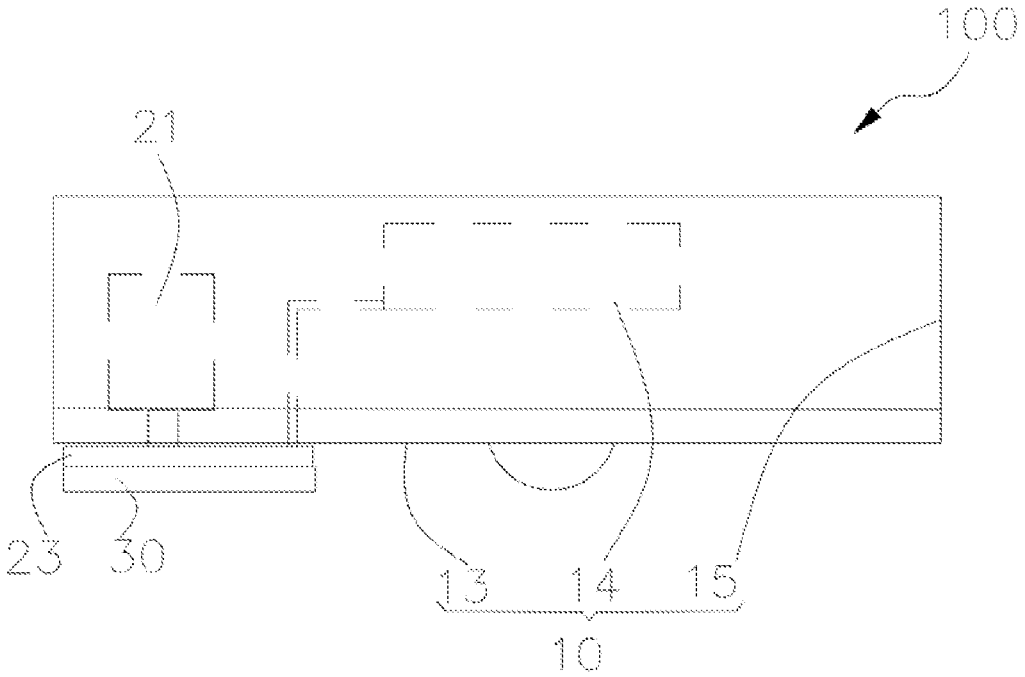
FIG. 4 is a first structural schematic view of the cleaning device provided by an embodiment of the present disclosure.
Figure 5:
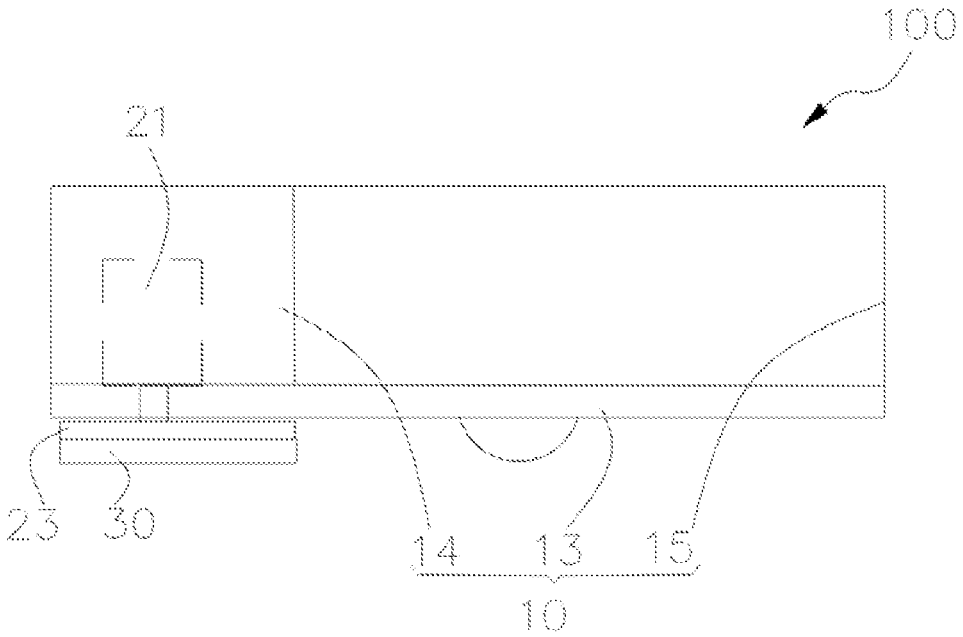
FIG. 5 is a second structural view of the cleaning device provided by an embodiment of the present disclosure.

Referring to FIGS. 4 and 5 again, the main body 10 further includes a cleaning box 14 connected to the chassis 13, and the chassis 13 carries the cleaning box 14. The cleaning box 14 is a dust box, or a water tank, or a combination of a dust box and a water tank. The cleaning box 14 and the chassis 13 can be assembled in a variety of forms. For example, the upper cover assembly 15 is provided with a mounting groove, and the cleaning box 14 is detachably arranged in the mounting groove. The bottom surface of the chassis 13 forms the bottom surface of the main body 10. In other embodiments, the chassis 13 is provided with a mounting groove on the peripheral side, so that a notch is formed on the peripheral side of the chassis 13. The cleaning box 14 is detachably arranged in the mounting groove. The bottom surface of the box 14 and the bottom surface of the chassis 13 constitute the bottom surface of the main body 10.

The driving device 21 is arranged on the chassis 13 or the cleaning box 14. In this embodiment, the driving device 21 is arranged on the chassis 13. The driving device 21 is arranged in the inner cavity between the chassis 13 and the upper cover assembly 15. In other embodiments, the driving device 21 may also be arranged in the cleaning box 14.

Referring to FIGS. 6 and 7 again, in this embodiment, the driving device 21 may include a driving motor 201 and a reducer 202. The reducer 202 is provided with an input shaft and the driving shaft 211. The driving motor 201 is fixedly mounted on the main body 10, and connected to the input shaft of the reducer 202, and configured to drive the input shaft of the reducer 202. The driving motor 201 transmits drive force to the reducer 202 through the input shaft, to drive the driving shaft 211 to rotate in a decreased speed and output a relatively large power torque to the movable bracket 23, thereby transmitting a relatively large torque to the movable bracket 23, and increasing the force of the cleaning assembly 30 to wipe the floor. In other embodiments, the driving device 21 includes a driving motor 201, and an output end of the driving motor 201 forms the driving shaft 211, so that the driving motor 201 directly transmits drive force through the driving shaft 211.

The extension direction of the driving shaft 211 is substantially parallel to the height direction of the main body 10, and the driving shaft 211 extends to be close to the bottom surface of the main body 10.

The movable bracket 23 is substantially in the shape of a flat plate, and the movable bracket 23 is movably connected to the bottom of the main body 10. The movement direction of the movable bracket 23 is substantially parallel to the surface 70 to be cleaned. In this embodiment, the reciprocating direction of the movable bracket 23 is perpendicular to the direction of what the two drive wheels 60 opposite to each other, that is, the movable bracket 23 can reciprocate in the forward direction of the cleaning device 100. In other embodiments, the reciprocating direction of the movable bracket 23 can also be set in parallel with the relative direction of the two drive wheels 60. Alternatively, the reciprocating direction of the movable bracket 23 may also be set at an angle with the relative direction of the two drive wheels 60.

Referring to FIGS. 6 and 7 again, in this embodiment, the movable bracket 23 may be slidably connected to the bottom of the main body 10, to realize that the movable bracket 23 may be movably connected to the bottom of the main body 10. The movable bracket 23 is provided with at least one sliding groove 232. The bottom of the main body 10 is protrudingly provided with at least one guide slider 12, and the at least one guide slider 12 is respectively slidably fitted to the at least one sliding groove 232. The at least one sliding groove 232 is a long sliding groove, and the extension length of the at least one sliding groove 232 is greater than or equal to the movement stroke of the movable bracket 23. In this embodiment, the movable bracket 23 is provided with a first sliding groove 2321, a second sliding groove 2322, and a third sliding groove 2323. The first sliding groove 2321 and the second sliding groove 2322 are respectively symmetrically arranged at the left and right sides of the movable bracket 23, and the third sliding groove 2323 is provided in the middle of the movable bracket 23. The third sliding groove 2323, the first sliding groove 2321, and the second sliding groove 2322 are substantially distributed in a triangle. The at least one guide slider 12 includes a first guide slider 121, a second guide slider 122 and a third guide slider 123. The first guide slider 121 is slidably fitted to the first sliding groove 2321, the second guide slider 122 is slidably fitted to the second sliding groove 2322, and the third guide slider 123 is slidably fitted to the third sliding groove 2322, so as to provide a smooth sliding guide for the movable bracket 23. Therefore, it may prevent the movable support 23 from shaking violently when the movable support 23 reciprocates and is hindered by external obstacles, and avoiding the violent shaking of the cleaning device 100 while the cleaning device 100 is automatically walking.

The number of the first sliding grooves 2321 may be one or more, the number of the second sliding grooves 2322 may be one or more, and the number of the third sliding groove 2323 may be one or more. The number of the first guide sliders 121 is the same as the number of the first sliding grooves 2321. The number of the second guide sliders 122 is the same as the number of the second sliding grooves 2322, and the number of the third guide sliders 123 is the same as the number of the third sliding grooves 2323. In other embodiments, the movable bracket 23 may not be provided with the third sliding groove 2323, and the main body 10 may not be provided with the third guide slider 123.

In other embodiments, the bottom of the main body 10 is provided with at least one sliding groove 232, the movable bracket 23 is provided with at least one guide slider 12, and the at least one guide slider 12 has a sliding fit with the at least one sliding groove 232.

In other embodiments, the bottom of the main body 10 is provided with a guide rail structure, and the movable bracket 23 has a sliding fit with the guide rail structure to realize that the movable bracket 23 can be movably connected to the bottom of the main body 10.

In other embodiments, a plurality of elastic members may be provided between the movable bracket 23 and the bottom of the main body 10, and the plurality of elastic members serve to elastically connect the movable bracket 23 and the main body 10 to realize that the movable bracket 23 is movably connected to the bottom of the main body 10. The elastic member may be any one of a spring, a rubber member and a silicone member, or a combination thereof.

Figure 6:
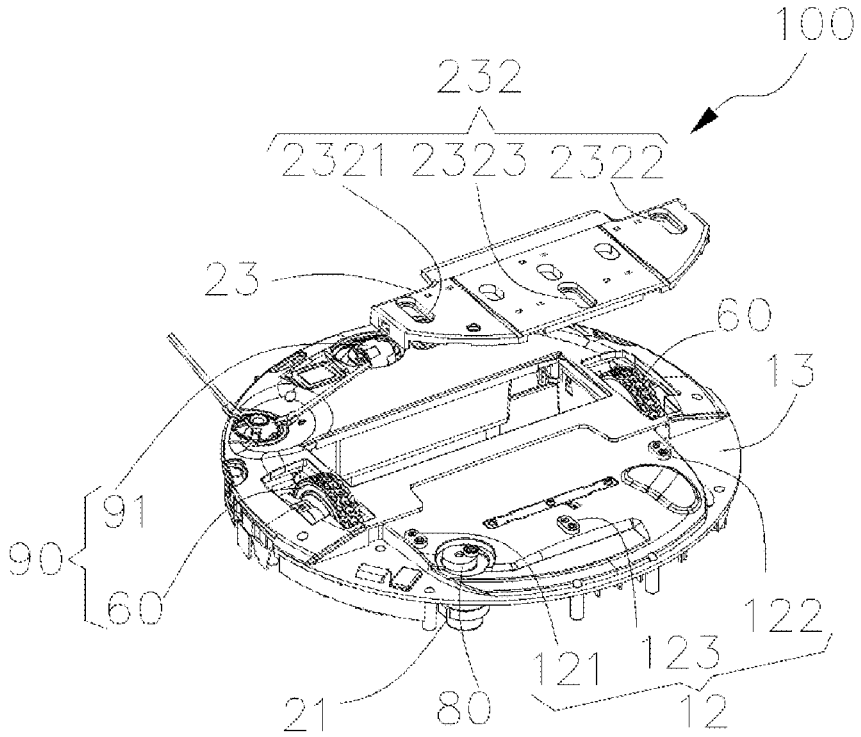
FIG. 6 is a third exploded view of some parts of the cleaning device provided by an embodiment of the present disclosure.
Figure 7:
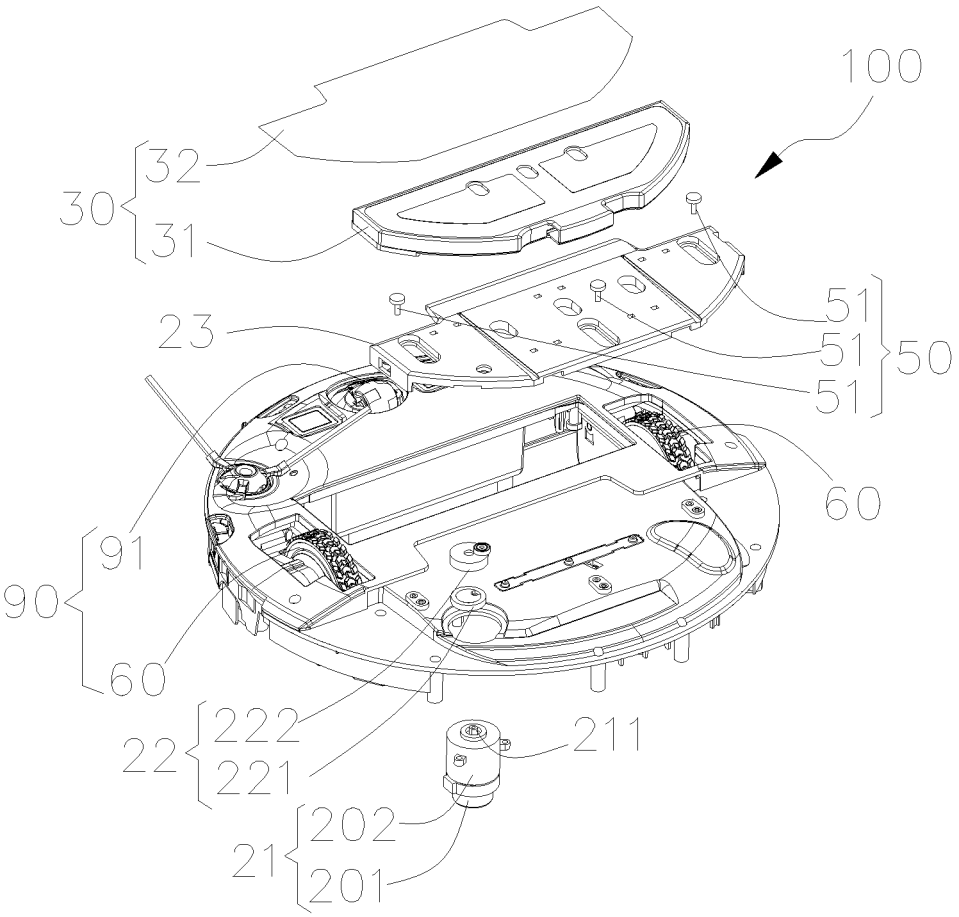
FIG. 7 is a fourth exploded view of some parts of the cleaning device provided by an embodiment of the present disclosure.
Figure 8:
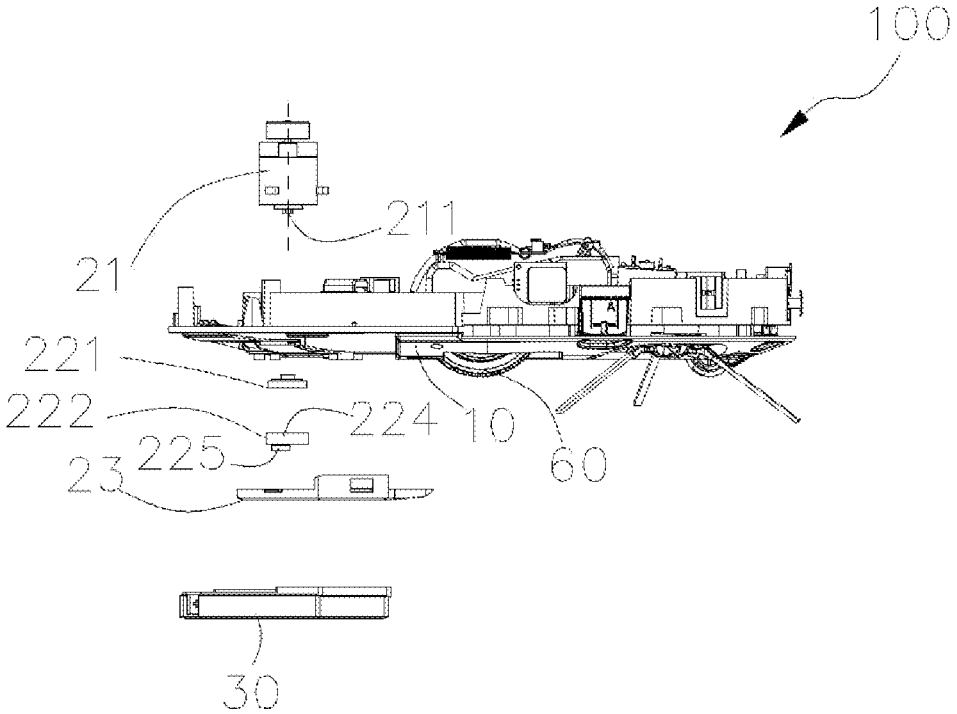
FIG. 8 is a fifth exploded view of some parts of the cleaning device provided by an embodiment of the present disclosure.
Figure 9:
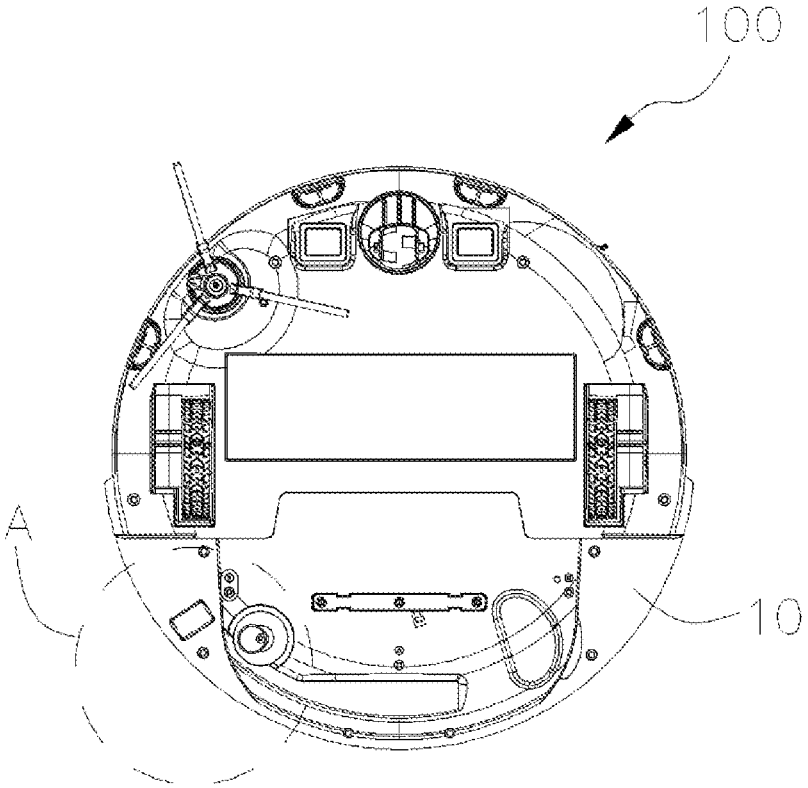
FIG. 9 is a third structural view of the cleaning device provided by an embodiment of the present disclosure.
Figure 10:
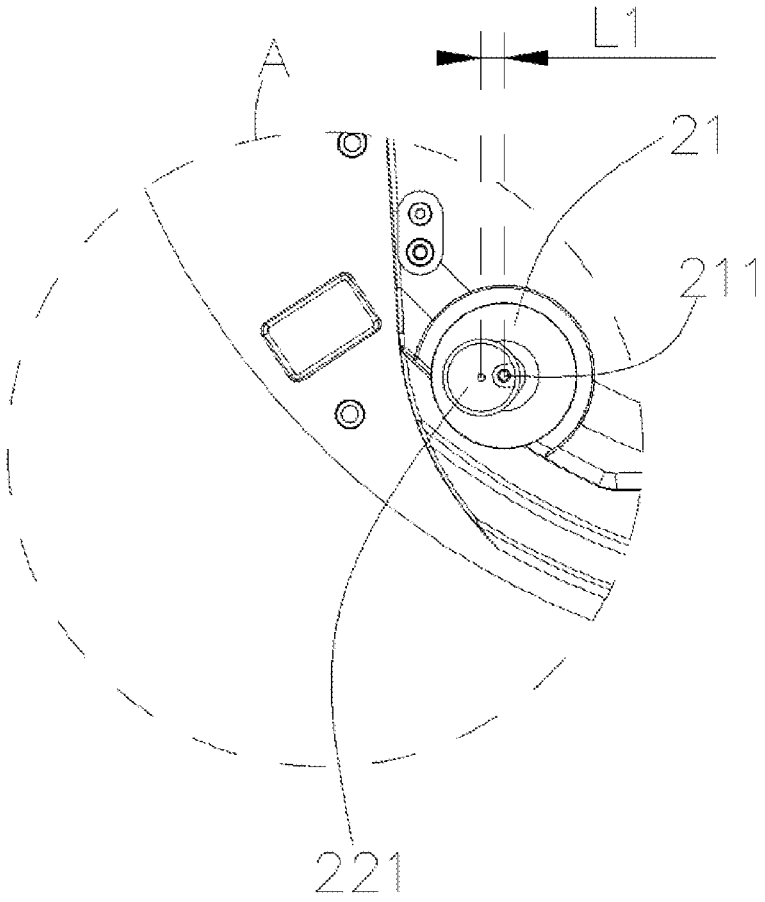
FIG. 10 is an enlarged view of a position A in FIG. 9 (an assembly structure of a first transmission member and a driving shaft).
Figure 11:
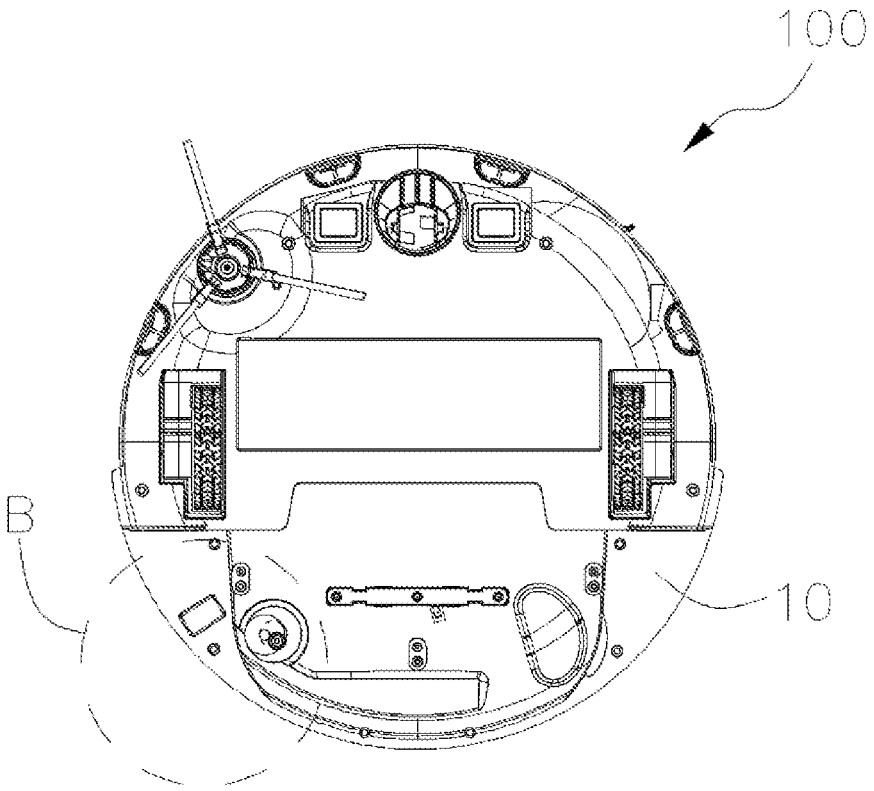
FIG. 11 is a fourth structural view of a cleaning device provided by an embodiment of the present disclosure.
Figure 12:
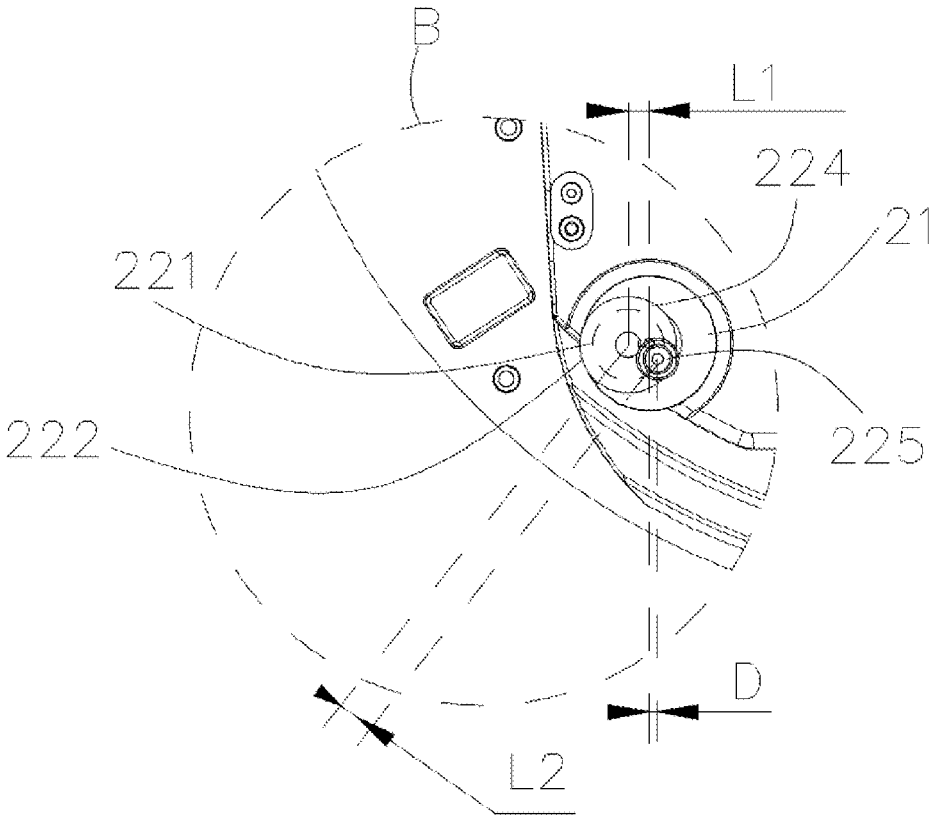
FIG. 12 is an enlarged view of a position B in FIG. 11 (a sequential assembly structure of a second transmission member, the first transmission member and the driving shaft).

Referring to FIGS. 6 and 7, the cleaning assembly 30 includes a flexible cleaning member 32. The flexible cleaning member 32 can be directly or indirectly attached to a side of the movable bracket 23 away from the movable bracket 23 by means of Velcro, hook or buckle. The flexible cleaning member 32 may reciprocate with the movable bracket 23, and the flexible cleaning member 32 is deployed along the surface of the movable bracket 23 facing away from the bottom of the main body 10. The flexible cleaning member 32 may contact the surface 70 to be cleaned, and the flexible cleaning member 32 covers a larger area of the surface to be cleaned, which is beneficial to improve the cleaning effect. The material of the flexible cleaning member 32 may be one or a combination of fiber, cotton, and collodion. The flexible cleaning member 32 can be a single-layer structure or a multi-layer composite structure, which can be set by those skilled in the art according to actual needs.

Referring to refer to FIGS. 7 to 12, in this embodiment, the at least one transmission member 22 includes a first transmission member 221 and a second transmission member 222. The first transmission member 221 is fixedly connected to the driving shaft 211. The second transmission member 222 is provided with a first connecting part 224 and a second connecting part 225. The first connecting part 224 is rotatably connected to the first transmission member 221, and a center distance between the first connecting part 224 and the driving shaft 211 in a direction perpendicular to the driving shaft 211 is defined as a first distance L1. The second connecting part 225 is rotatably connected to the movable bracket 23, and a center distance between the second connecting part 225 and the first connecting part 224 in a direction perpendicular to the driving shaft 211 is defined as a second distance L2. The first distance L1 and the second distance L2 are both non-zero, and the second distance L2 is greater than or equal to the first distance L1.

The center distance between the first connecting part 224 and the driving shaft 211 in a direction perpendicular to the driving shaft 211 is a distance between the rotation center of the first connecting part 224 and a center of the driving shaft 211 in a direction perpendicular to the driving shaft 211. The center distance between the second connecting part 225 and the first connecting part 224 in a direction perpendicular to the driving shaft 211 is a distance between the rotation center of the second connecting part 225 and the rotation center of the first connecting part 224 in a direction perpendicular to the driving shaft 211.

The second connecting part 225 may reciprocate linearly with the movable bracket 23. The vertical distance from the center of the driving shaft 211 to the movement track of the second connecting part 225 is defined as a vertical distance D, and the vertical distance D satisfies $D \leq L2 - L1$, so that the first transmission member 221, the second transmission member 222, the movable bracket 23, and the main body 10 may form a crank slider mechanism. The first transmission member 221 is equivalent to a crank, and the first transmission member 221 can rotate 360° under the driving of the driving device 21. The second transmission member 222 is equivalent to a connecting rod, and is configured to connect the second transmission member 222 and the movable bracket 23. Since the movable bracket 23 is slidably connected to the bottom of the main body 10, the movable bracket 23 equivalent to a sliding member can slide back and forth on the bottom of the main body 10. The main body 10 is equivalent to a fixed frame, and is configured to stably connect the first transmission member 221 to the movable bracket 23.

The first transmission member 221 is driven to rotate by the driving shaft 211 of the driving device 21, and can transmit the rotating torque to the second transmission member 222, thereby driving the movable bracket 23 sliding back and forth in the bottom of the main body 10. The first connecting part 224 of the second transmission member 222 is rotatably connected to the first transmission member 221, and the second connecting part 225 of the second transmission member 222 is rotatably connected to the movable bracket 23, thereby realizing that the first transmission member 221 receives the rotation torque, and then the rotation torque is converted into a pushing torque by the second transmission member 222 to the movable bracket 23. Since the second transmission member 222 is rotatably connected to the first transmission member 221 and the movable bracket 23, the first transmission member 221, the second transmission member 222 and the movable bracket 23 form a crank-connecting rod-slider mechanism. There is no sliding friction loss among the second transmission member 222, the first transmission member 221 and the movable bracket 23, which is beneficial to avoid jamming or violent shaking of the movable bracket 23 while reciprocating.

The first connecting part 224 of the second transmission member 222 can be rotatably connected to the first transmission member 221 by means of a bearing, and the second connecting part 225 of the second transmission member 222 can be rotatably connected to the movable bracket 23 by means of a bearing, to achieve a smooth rotation and reduce rotational friction. Of course, in other embodiments, the above-mentioned bearing structure can also be cancelled.

Figure 13:
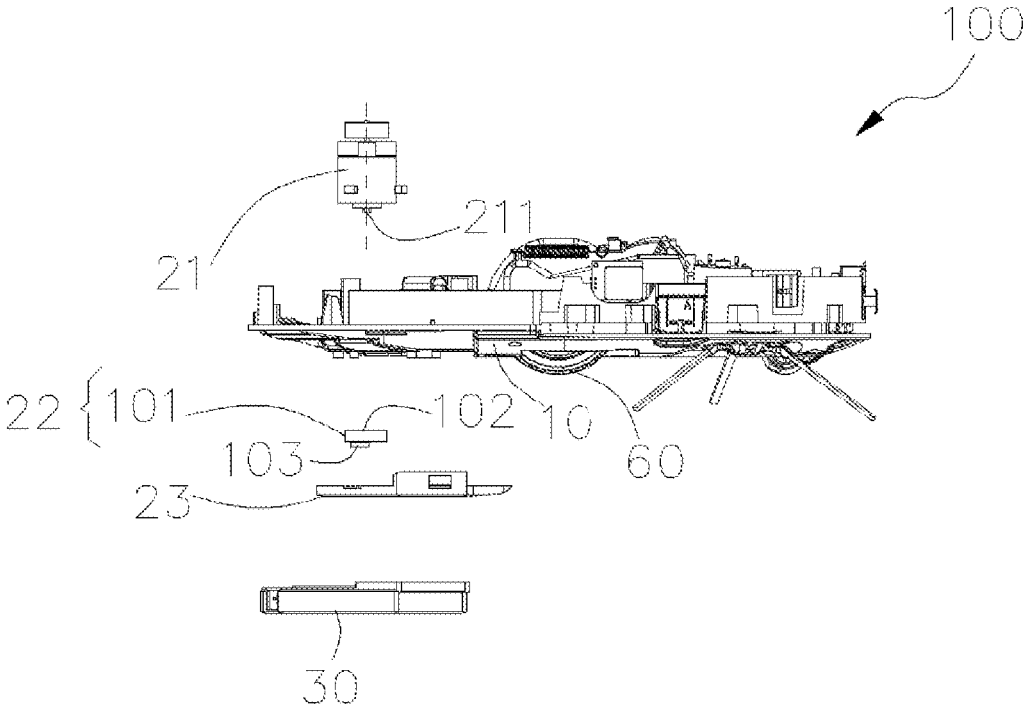
FIG. 13 is a sixth exploded view of some parts of the cleaning device provided by another embodiment.

Referring to FIG. 13, in other embodiments, the at least one transmission member 22 includes a transmission member 101, and the transmission member 101 is provided with a first connecting part 102 and a second connecting part 103. The first connecting part 102 is fixedly connected to the driving shaft 211, and the second connecting part 103 is slidably connected to the movable bracket 23. The second connecting part 103 and the movable bracket 23 are approximately positioned on the same plane, and the sliding direction of the second connecting part 103 is perpendicular to the sliding direction of the movable bracket 23. Moreover, the center of the second connecting part 103 and the center of the driving shaft 211 are arranged at interval in a direction perpendicular to the extension direction of the driving shaft 211, that is, the second connecting part 103 is offset from the center of rotation of the transmission member 101. The first connecting part 102 may include a shaft hole structure matched with the driving shaft 211, and the second connecting part 103 may include a slider structure matched with a sliding groove on the movable bracket 23.

The driving shaft 211 of the driving device 21 can drive the transmission member 101 to rotate, and the transmission member 101 can push the movable bracket 23 to reciprocate linearly through the second connecting part 225 arranged eccentrically during the rotation.

Figure 14:
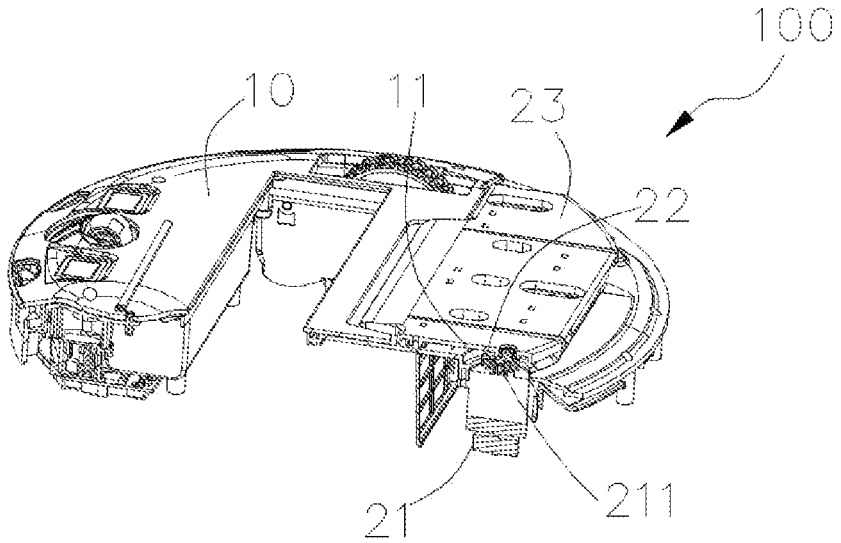
FIG. 14 is a second longitudinal cross-sectional view of the cleaning device provided by an embodiment of the present disclosure.

Referring to FIG. 14, further, the bottom of the main body 10 is provided with a groove 11. The driving shaft 211 extends into the groove 11, and the at least one transmission member 22 is at least partially accommodated inside the groove 11. The movable bracket 23 is arranged to cover the groove 11 of the main body 10 and the at least one transmission member 22. In this embodiment, the at least one transmission member 22 is positioned at the bottom of the main body 10, and the groove 11 provides a movement space for the at least one transmission member 22, which can avoid increasing the overall height of the cleaning device 100 in the event that the at least one transmission member 22 is arranged inside the main body 10, thereby. The movable bracket 23 covers the groove 11 of the main body 10 and the at least one transmission member 22 to hide the groove 11 of the main body 10 and the at least one transmission member 22, thus preventing external dust or hair or large-particle garbage from entering the groove 11 and obstructing the at least one transmission member 22, and simplifying the appearance of the cleaning device 100.

Figure 15:
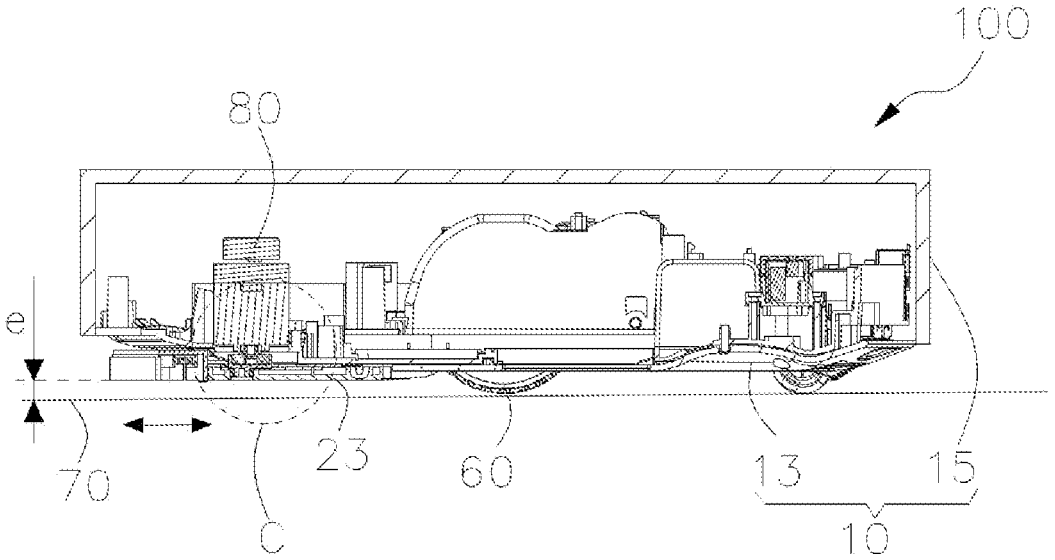
FIG. 15 is a third longitudinal cross-sectional view of the cleaning device provided by an embodiment of the present disclosure.

Referring to FIGS. 1 and 15, further, the movable bracket 23 is spaced from the surface 70 to be cleaned, and distance e between the movable bracket 23 and the surface 70 to be cleaned meets a preset distance threshold, so that when the cleaning assembly 30 is disassembled and separated from the movable bracket 23, a relatively large distance is maintained between the movable bracket 23 and the surface 70 to be cleaned, so as to avoid that the movable bracket 23 obstructs the cleaning device 100 from climbing the obstacles on the floor, which is beneficial to improve the obstacle-climbing capability of the cleaning device 100. Those skilled in the art can adjust the specific value of the preset distance threshold according to actual obstacle-climbing needs. For example, the preset distance threshold may be 4 mm to 8 mm, and the preset distance threshold may be 4 mm, 4.5 mm, 5 mm, 5.5 mm or 6 mm, etc.

Figure 16:
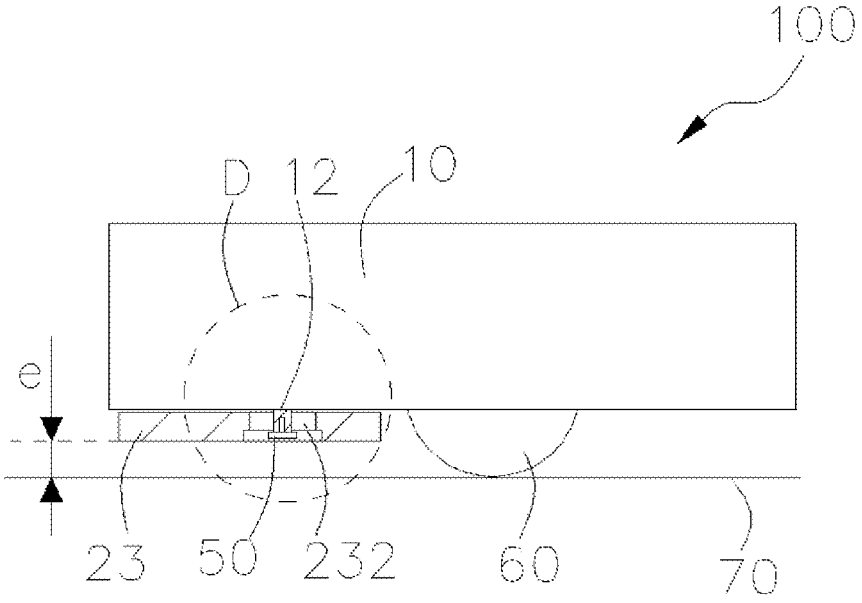
FIG. 16 is a fifth structural view of the cleaning device provided by an embodiment of the present disclosure.
Figure 18:
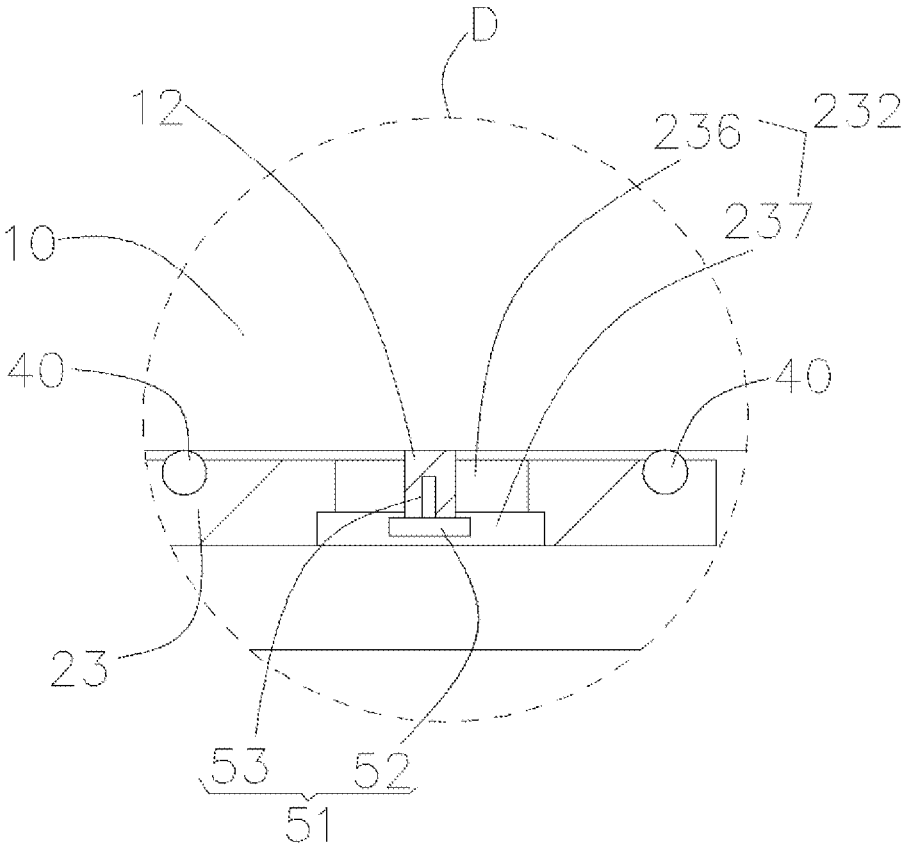
FIG. 18 is an enlarged view of a position D in FIG. 16 (an assembly structure of a limiting member and the movable bracket).
Figure 19:
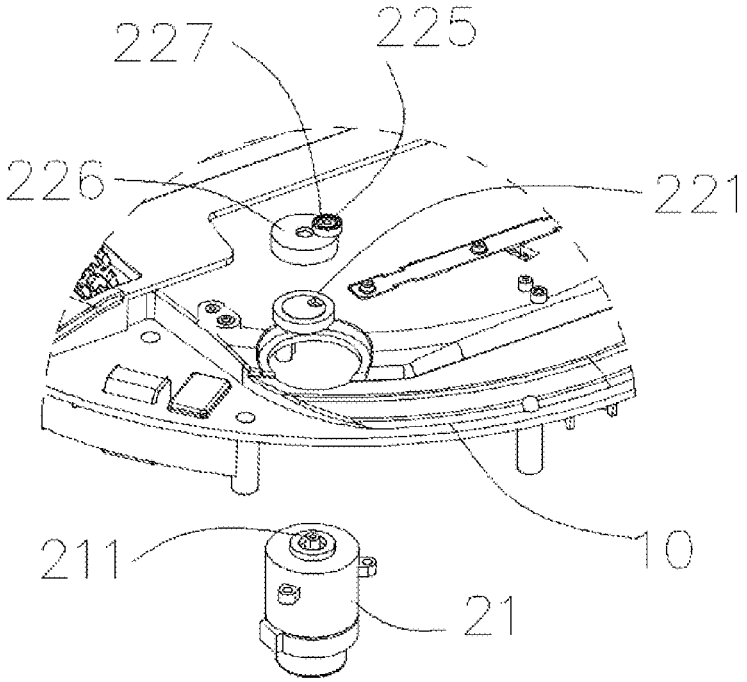
FIG. 19 is an exploded view of a partial structure of the cleaning device provided by an embodiment of the present disclosure.
Figure 20:
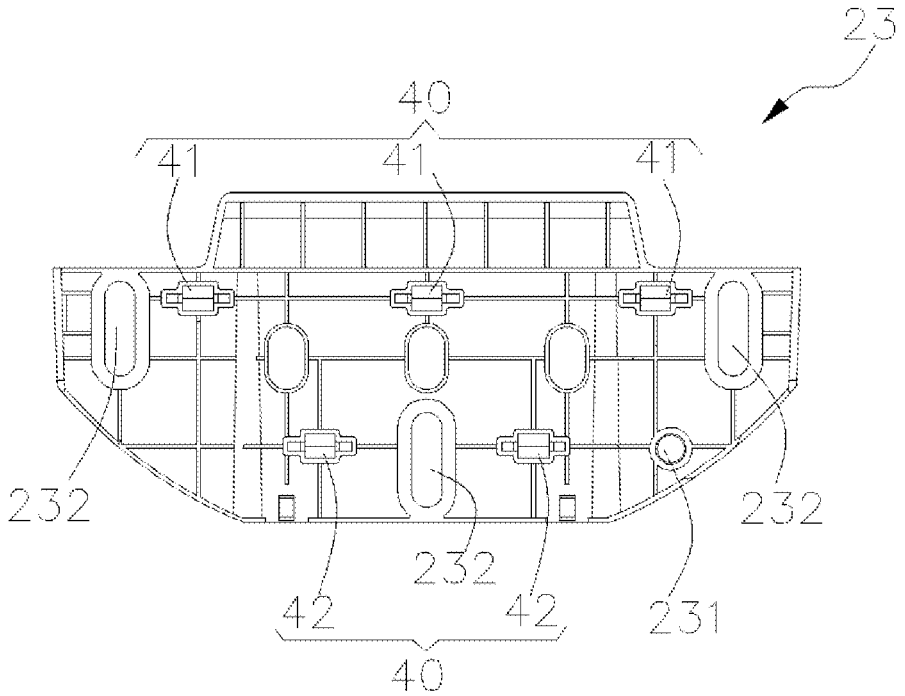
FIG. 20 is a structural view of the movable bracket of the cleaning device provided by an embodiment of the present disclosure.

Referring to FIGS. 7, 16 and 18, further, the cleaning device 100 further includes a limiting assembly 50, the limiting assembly 50 is connected to the bottom of the main body 10, and restricts the movable bracket 23 at the pre-set position, so that the distance e between the movable bracket 23 and the surface 70 to be cleaned meets the preset distance threshold. The limiting assembly 50 does not affect the reciprocating movement of the movable bracket 23 in a direction perpendicular to the driving shaft 211.

In this embodiment, the limiting assembly 50 includes at least one limiting member 51, and the at least one limiting member 51 is respectively fixedly connected to the at least one guide slider 12. Each limiting member 51 is provided with a limiting part 52 positioned in the at least one sliding groove 232, and the limiting portion 52 is configured to abut and resist a side of the movable bracket 23 away from the side of the main body 10, to restrict the movable bracket 23 from separating from the at least one guide slider 12 and restrict the movable bracket 23 to a preset position, so that the distance between the movable bracket 23 and the surface 70 to be cleaned meets the preset distance threshold.

The at least one sliding groove 232 of the movable bracket 23 has a first part 236 and a second part 237 communicating with the first part 236. Both the first part 236 and the second part 237 are strip-shaped grooves, and extend along the length direction of the sliding groove 232. The guide slider 12 is accommodated in the first part 236 so that the at least one guide slider 12 has the sliding fit with the first part 236 of the at least one sliding groove. The limiting member 51 includes a connecting rod 53 and a limiting part 52 fixedly connected to the connecting rod 53. One end of the connecting rod 53 is connected to the at least one guide slider 12 of the main body 10. The limiting portion 52 is connected to an end of the connecting rod 53 away from the at least one guide slider 12, and the cross-sectional dimension of the limiting portion 52 is larger than the cross-sectional dimension of the connecting rod 53, and is larger than the cross-sectional dimension of the guide slider. The second part 237 has a step surface away from the bottom of the main body 10, and the limiting portion 52 is accommodated in the second part 237 of the at least one sliding groove 232 and abuts against the step surface to limit the movable bracket 23.

By restricting the separation of the movable bracket 23 from the at least one guide slider 12 by the at least one limiting member 51, the movable bracket 23 can be prevented from being separated from the at least one guide slider 12 and failing to work normally. The limiting member 51 may be a screw, a rivet, or other limiting structural member, which is not limited herein. The number of the limiting members 51 can be determined according to the number of the guide sliders 12. For example, each guide slider 12 may be fixedly connected to at least one limiting member. In some embodiments, the at least one limiting member 51 may be connected to on the main body 10 in a non-detachable manner, such as by glue, so as to prevent the user from disassembling the limiting member 51, or prevent the vibration of the movable bracket 23 from causing the at least one limiting member 51 to loosen.

The distance e between the movable bracket 23 and the surface 70 to be cleaned meets the preset distance threshold, which is beneficial to improve the obstacle-climbing capability of the cleaning device 100. When the cleaning assembly 30 is detached from the movable bracket 23, due to the function of the limiting assembly 50, the movable bracket 23 cannot get close to the floor under the action of gravity, and the movable bracket 23 and the surface 70 to be cleaned still maintain a relatively large distance. Therefore, when the cleaning device 100 climbs an obstacle, the movable bracket 23 is not easily stuck on the obstacle. When the cleaning assembly 30 is arranged on the side of the movable bracket 23 close to the surface 70 to be cleaned, the movable bracket 23 can drive the cleaning assembly 30 to reciprocate relative to the surface 70 to be cleaned, so that the cleaning task of scrubbing can be performed.

The preset distance threshold is greater than half of the minimum distance between the bottom of the main body 10 and the surface 70 to be cleaned. In some embodiments, the minimum distance between the bottom surface of the main body 10 and the surface 70 to be cleaned is close to 10 mm, and the preset distance threshold may be greater than 5 mm. For example, the preset distance threshold may be 5.1 mm, 5.4 mm, 5.7 mm, 6.0 mm or above 6.0 mm. Of course, in other embodiments, the minimum distance between the bottom surface of the main body 10 and the surface 70 to be cleaned can also be other values, which can be set by those skilled in the art according to actual needs.

In other embodiments, the limiting member 51 may also be a guide rail structure arranged at the bottom of the main body 10, and the movable bracket 23 has sliding fit with the guide rail structure. The guide rail structure can restrict the movable bracket 23 from moving away from the bottom of the main body 10, thereby preventing the movable bracket 23 from getting close to the surface 70 to be cleaned under the action of gravity.

Referring to FIG. 15, FIG. 17, FIG. 19, and FIG. 20, further, the first connecting part 224 and the second connecting part 225 are arranged in sequence in a direction parallel to the driving shaft 211. One side of the first connecting part 224 away from the second connecting part 225 abuts against the first transmission member 221, and one side of the second connecting part 225 away from the first connecting part 224 abuts against the movable bracket 23.

In this embodiment, the first connecting part 224 and the second connecting part 225 are arranged in sequence in a direction parallel to the driving shaft 211, so that the first connecting part 224 and the second connecting part 225 forms a vertical stacking structure, so that the movable bracket 23 can stably resist the force pushed back by obstacles on the floor, and the movable bracket 23 is more stable while reciprocating.

In this embodiment, the movable bracket 23 is provided with a first shaft hole 231 on the side close to the bottom of the main body 10, and the extension direction of the first shaft hole 231 is parallel to the extension direction of the driving shaft 211. The second connecting part 225 includes a convex shaft 227, and the second connecting part 225 is rotatably fitted in the first shaft hole 231 through the convex shaft 227. The convex shaft 227 can be rotatably fitted in the first shaft hole 231 by means of a bearing, and the bearing can be any of different types of bearings such as a sliding bearing, an articulated bearing, a deep groove ball bearing, or a self-aligning ball bearing. In other embodiments, the convex shaft 227 is in clearance fit with the first shaft hole 231, and lubricating oil can be added to the gap between the convex shaft 227 and the first shaft hole 231 to reduce rotational friction. In other embodiments, the first shaft hole 231 is arranged on the first connecting part 224, and the convex shaft 227 is arranged on the movable bracket 23.

The second transmission member 222 is rotatably connected to the first transmission member 221 and the movable bracket 23. The first transmission member 221, the second transmission member 222 and the movable bracket 23 form a crank-connecting rod-slider mechanism, and the assembly precision between the second transmission member 222 and the first transmission member 221, and between the second transmission member 222 and the movable bracket 23 are high, so that the movable bracket 23 can be stably maintained in the horizontal direction, which is beneficial to avoid jamming or violent shaking of the movable bracket 23 while reciprocating. There is no sliding friction loss between the second transmission member 222 and the first transmission member 221, and there is no sliding friction loss between the second transmission member 222 and the movable bracket 23, which is beneficial to avoid jamming or violent shaking of the movable bracket 23 while reciprocating.

Referring to FIG. 15, FIG. 17, FIG. 19 and FIG. 20, further, the first connecting part 224 and the first transmission member 221 are arranged to be at least overlapped with each other in a direction parallel to the extension direction of the driving shaft 211, and the second connecting part 225 and the movable bracket 23 are at least partially overlapped in the extension direction parallel to the driving shaft 211.

In this embodiment, the vertical stack structure composed of the first connecting part 224 and the second connecting part 225 forms the main part of the second transmission member 222, and the second transmission member 222 has a certain height and occupies a certain space in a direction parallel to the extension direction of the driving shaft 211. Since the distance between the bottom of the main body 10 and the surface 70 to be cleaned may be relatively small (usually 9 mm to 10 mm), to avoid the situation of the second transmission member 222 occupying too much space in a direction parallel to the extension direction of the driving shaft 211 and an insufficient arrangement space of the movable bracket 23 and the cleaning assembly 30, the first connecting part 224 of the second transmission member 222 and the first transmission member 221 are at least partially overlapped in a direction parallel to the extension direction of the driving shaft 211, which can compress the height of the assembly structure composed of the first transmission member 221, the second transmission member 222, and the movable bracket 23 in a direction parallel to the driving shaft 211, so that the first transmission member 221 and the second transmission member 222 can be arranged in the narrow space between the movable bracket 23 and the bottom of the main body 10, thereby making it possible to maintain a small movement gap between the movable bracket 23 and the bottom of the main body 10.

In this embodiment, the convex shaft 227 of the second connecting part 225 is rotatably fitted in the first shaft hole 231 of the movable bracket 23, thereby realizing that the second connecting part 225 and the movable bracket 23 are at least partially overlapped in a direction parallel to the extension direction of the driving shaft 211. The first transmission member 221 is rotatably fitted in the second shaft hole 228 of the first connecting part 224 to realize that the first connecting part 224 of the second transmission member 222 and the first transmission member 221 are at least partially overlapped in a direction parallel to the extension direction of the driving shaft 211.

It can be seen that the first transmission member 221, the second transmission member 222, and the movable bracket 23 are nested in sequence in a direction parallel to the extension direction of the driving shaft 211, so that the entire structure composed of the three components is compact and small, and has small height in the extension direction parallel to the drive shaft 211. In addition, it can effectively resist the disturbance and impact perpendicular to the extension direction of the driving shaft 211, which is beneficial to reduce loss and increase service life, so that the movable bracket 23 is more stable while reciprocating.

Referring to FIG. 15, FIG. 17, FIG. 19 and FIG. 20, further, the first connecting part 224 includes a rotating main body 226, which is connected to an end of the convex shaft 227 away from the movable bracket 23. The surface of the rotating main body 226 away from the convex shaft 227 is recessed to form a second shaft hole 228. The extension direction of the second shaft hole 228 is parallel to the extension direction of the driving shaft 211, and the first transmission member 221 is at least partially accommodated in the second shaft hole 228 and is rotatably fitted in the second shaft hole 228.

In this embodiment, the first transmission member 221 may be a round wheel, and the first transmission member 221 is completely accommodated in the second shaft hole 228. The first transmission member 221 can be rotatably fitted in the second shaft hole 228 by means of a bearing, so that the assembly height and the assembly volume of the first transmission member 221 and the second transmission member 222 are minimized, and higher matching accuracy is obtained. The first transmission member 221 is provided with an eccentric hole to position and fit the driving shaft 211, that is, the center of the first transmission member 221 is spaced from the axis of the driving shaft 211. The driving shaft 211 can drive the first connecting part 224 of the second transmission member 222 to deflect by the first transmission member 221, and then transmit torque to the second connecting part 225 of the second transmission member 222 to propel the movable bracket 23 to reciprocate.

Referring to FIG. 15, FIG. 17, FIG. 19 and FIG. 20, further, the orthographic projection of the first connecting part 224 on the movable bracket 23 covers the orthographic projection of the second connecting part 225 on the movable bracket 23, making the structure of the second transmission member 222 smaller in size, which is beneficial to improve the compactness of the structure. The first connecting part 224 is substantially circular, and the second connecting part 225 is substantially circular. The cross-sectional area of the first connecting part 224 is larger than the cross-sectional area of the second connecting part 225.

Referring to FIG. 15, FIG. 17, FIG. 19 and FIG. 20, further, the orthographic projection of the first connecting part 224 at the bottom of the main body 10 covers the orthographic projection of the first transmission member 221 on the bottom of the main body 10, making the overall structure of the second transmission member 222 and the first transmission member 221 smaller in size, which is beneficial to improve the compactness of the structure. The first transmission member 221 is substantially circular, and the cross-sectional area of the first transmission member 221 is smaller than the cross-sectional area of the first connecting part 224.

Figure 17:
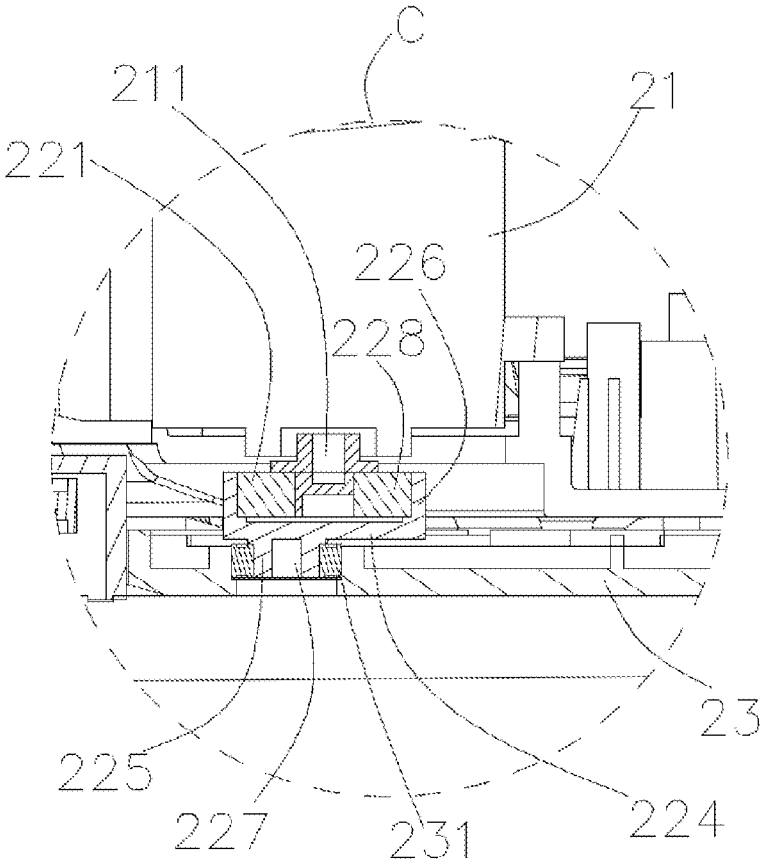
FIG. 17 is an enlarged view of a position C in FIG. 15 (an assembly structure of the movable bracket, the second transmission member, the first transmission member and a driving device).

Referring to FIG. 15, FIG. 17 and FIG. 18, further, the second connecting part 225 protrudes relative to the bottom surface of the main body 10, to support the movable bracket 23, so that a movement gap is reserved between the movable bracket 23 and the main body 10, and the movable bracket 23 can be "suspended" at the bottom of the main body 10, thereby reducing or even eliminating the frictional resistance and friction noise between the movable bracket 23 and the main body 10, which is conducive to improving user experience.

Referring to FIG. 15, FIG. 17, FIG. 18 and FIG. 20, further, there is a movement gap reserved between the movable bracket 23 and the main body 10. The cleaning device 100 includes at least one roller 40, and the at least one roller 40 is rotatably connected to the movable bracket 23. The at least one roller 40 is partially positioned in the movement gap and rolls against a side of the main body 10 close to the movable bracket 23. Alternatively, the at least one roller 40 is rotatably connected to the bottom of the main body 10, and the at least one roller 40 is partially positioned in the movement gap and rolls against a side of the movable bracket 23 close to the main body 10.

In this embodiment, the movable bracket 23 is provided with a plurality of first roller grooves on the side close to the bottom of the main body 10, and the plurality of first roller grooves are arranged in a straight line in the first preset position of the movable bracket 23. The arrangement direction of the plurality of first roller grooves is perpendicular to the reciprocating direction of the movable bracket 23. The plurality of first roller grooves may include two or more first roller grooves. The at least one roller 40 includes a plurality of first rollers 41. The plurality of first rollers 41 are respectively arranged in the plurality of first roller grooves, and the plurality of first rollers 41 are rotatably connected to the movable bracket 23. The plurality of first rollers 41 roll against the bottom surface of the main body 10. The plurality of first rollers 41 provide support for the movable bracket 23 at the first preset position, so that the movable bracket 23 can maintain a movement gap with the bottom of the main body 10. When the movable bracket 23 reciprocates relative to the bottom of the main body 10, the plurality of first rollers 41 can follow the movable bracket 23 to move and roll along the bottom surface of the main body 10. In other embodiments, the at least one roller 40 is rotatably connected to the bottom of the main body 10.

In some embodiments, the movable bracket 23 is further provided with a plurality of second roller grooves on the side close to the bottom of the main body 10, and the plurality of second roller grooves are arranged in a straight line on the second preset position of the movable bracket 23. The arrangement direction of the plurality of second roller grooves is perpendicular to the reciprocating direction of the movable bracket 23, and the second preset position and the first preset position are arranged at intervals in a direction of the reciprocating motion of the movable bracket 23. The plurality of second roller grooves may include two or more second roller grooves. The at least one roller 40 also includes a plurality of second rollers 42 rotatably connected to the movable bracket 23, and the plurality of second rollers 42 roll against the bottom surface of the main body 10. The plurality of second rollers 42 provide support for the movable bracket 23 at the second preset position, so that a uniform movement gap is maintained between the movable bracket 23 and the bottom of the main body 10 in the front and rear directions. When the movable bracket 23 reciprocates relative to the bottom of the main body 10, the plurality of second rollers 42 can follow the movable bracket 23 to move and roll along the bottom surface of the main body 10.

Figure 21:
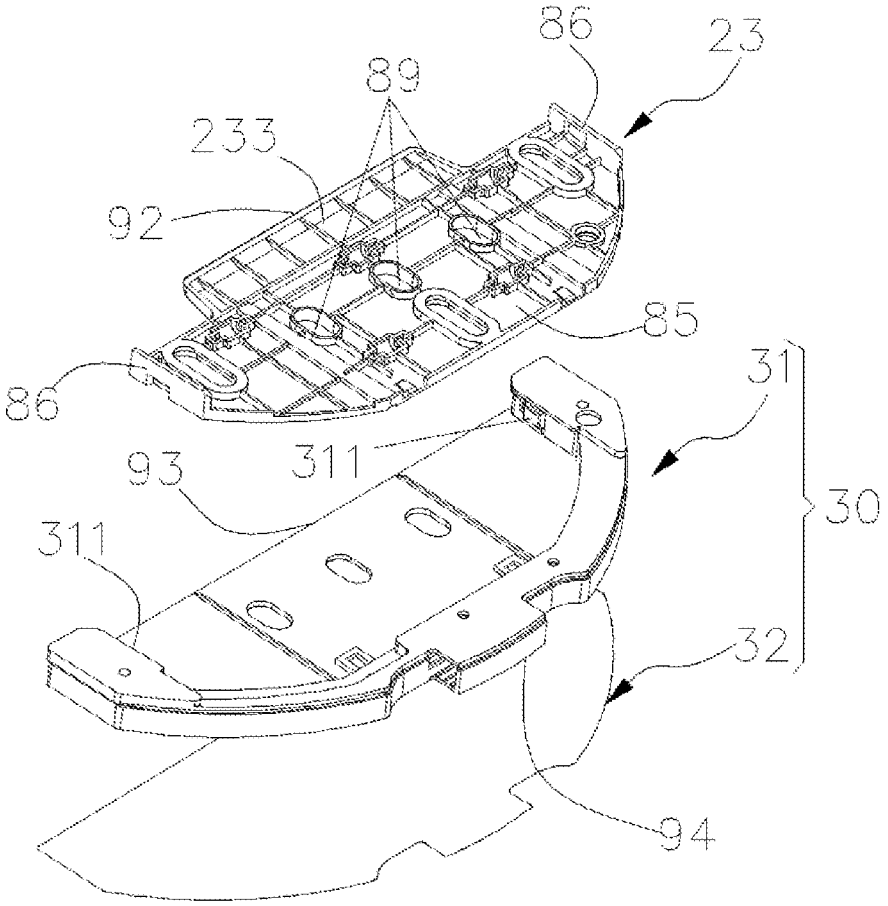
FIG. 21 is a structural view of the movable bracket and the cleaning assembly of the cleaning device provided by an embodiment of the present disclosure.
Figure 22:
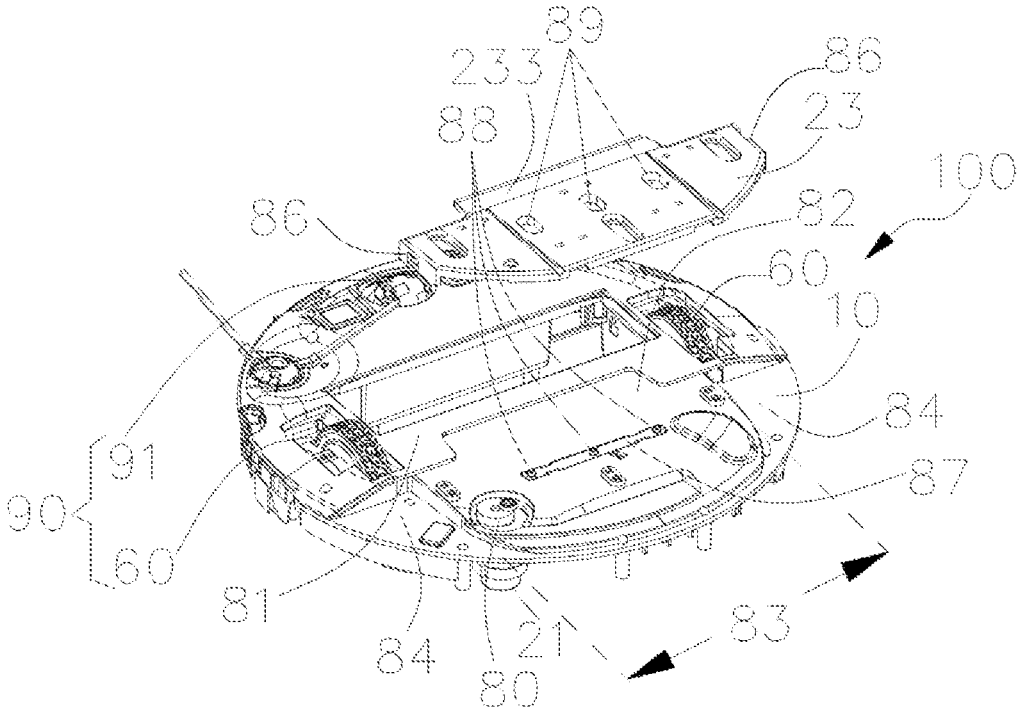
FIG. 22 is a seventh exploded view of some parts of the cleaning device provided by an embodiment of the present disclosure.

Referring to FIG. 1, FIG. 21 and FIG. 22, further, the cleaning assembly 30 and the movable bracket 23 are at least partially overlapped in a direction perpendicular to the surface 70 to be cleaned.

In this embodiment, the cleaning assembly 30 includes a supporting plate 31 and a flexible cleaning member 32. The supporting plate 31 is detachably connected to the movable bracket 23, and the supporting plate 31 is superimposed on a side of the movable bracket 23 away from the main body 10. The flexible cleaning member 32 is detachably connected to a side of the supporting plate 31 away from the movable bracket 23. The supporting plate 31 is substantially in the shape of a flat plate, and the supporting plate 31 can be snap-fitted to the movable bracket 23. The supporting plate 31 is provided with two engaging parts 311 arranged opposite to each other, and the two engaging parts 311 are respectively joined to two ends of the movable bracket 23. The supporting plate 31 can also be provided with a movable operating part 312, and the operating part 312 is connected to the two engaging parts 311. By operating the operating part 312, the two engaging parts 311 can be engaged with or separated from the movable bracket 23, thereby facilitating assembling or disassembling the cleaning assembly 30. The operating part 312 may have mechanical linkage with the two engaging parts 311 by means of a linkage mechanism, or the operating part 312 and the engaging part 311 are integrally provided. The flexible cleaning member 32 can refer to the previous description, which will not be repeated herein.

In some embodiments, the cleaning assembly 30 may completely cover the movable bracket 23. On the one hand, the deployment area of the cleaning assembly 30 can be increased, so as to provide a large area of cleaning effect, which is beneficial to improve cleaning efficiency. On the other hand, the movable bracket 23 is not in contact with the surface 70 to be cleaned, so that rigid collisions between the movable bracket 23 and the surface 70 to be cleaned can be avoided, and the movable bracket 23 is prevented from being damaged by impact. Of course, in other embodiments, the cleaning assembly 30 may also partially cover the movable bracket 23.

In other embodiments, the cleaning assembly 30 includes a flexible cleaning member 32, and the flexible cleaning member 32 may be directly attached to the side of the movable bracket 23 away from the main body 10 by means of Velcro, hook or buckle.

Further, the thickness of the cleaning assembly 30 is less than or equal to the distance between the movable bracket 23 and the surface 70 to be cleaned. The main body 10 includes at least one elastic member. The at least one elastic member is elastically arranged between the cleaning assembly 30 and the movable bracket 23 or the main body 10, to provide the elastic force to press the cleaning assembly 30 to contact the surface 70 to be cleaned.

In this embodiment, the overall thickness of the supporting plate 31 and the flexible cleaning member 32 may be smaller than the distance between the movable bracket 23 and the surface 70 to be cleaned. The flexible cleaning member 32 can contact the floor under the gravity of the supporting plate 31. In order to increase the contact degree of the flexible cleaning member 32 and the floor, an elastic element can be provided between the supporting plate 31 and the bottom of the main body 10. Alternatively, an elastic member is provided between the supporting plate 31 and the bottom of the movable bracket 23, and the elastic member can be any one of a spring button, a spring, a rubber member, a silicone member, a plastic spring sheet and a metal spring sheet. In other embodiments, the overall thickness of the supporting plate 31 and the flexible cleaning member 32 may be equal to the distance between the movable bracket 23 and the surface 70 to be cleaned.

Referring to FIG. 1, FIG. 21 and FIG. 22, further, a side of the main body 10 close to the surface 70 to be cleaned is provided with a first bottom surface 81 and a second bottom surface 82 adjacent to the first bottom surface 81. There is a height difference between the first bottom surface 81 and the second bottom surface 82, so that the distance between the first bottom surface 81 and the surface 70 to be cleaned is smaller than the distance between the second bottom surface 82 and the surface 70 to be cleaned. The at least one drive wheel 60 protrudes from the first bottom surface 81 and the movable bracket 23 is arranged on the second bottom surface 82.

Since the distance between the movable bracket 23 and the surface 70 to be cleaned may be large enough to improve the obstacle-climbing capability of the cleaning device 100, the movable bracket 23 may be arranged at a relatively large height from the surface 70 to be cleaned. Due to the height limit of the whole device, the minimum distance between the main body 10 and the surface 70 to be cleaned still needs to be kept within a reasonable range.

In this embodiment, the first bottom surface 81 of the main body 10 is provided with two wheel grooves arranged opposite to each other and a cleaning groove positioned between the two wheel grooves. The at least one drive wheel 60 includes two drive wheels 60 arranged opposite to each other. The two drive wheels 60 are respectively arranged in the two wheel grooves, and each of the drive wheels 60 partially extends out of the wheel groove. A rotatable cleaning roller brush can be arranged in the cleaning groove, and the cleaning groove communicates with the dust collecting chamber. The garbage can be lifted up by the rotation of the cleaning roller brush on the surface 70 to be cleaned, and then suck into the dust chamber by vacuum suction. In other embodiments, the cleaning device 100 may not be provided with the cleaning groove and the cleaning roller brush.

There is a height difference between the second bottom surface 82 and the first bottom surface 81, and the distance between the second bottom surface 82 and the surface to be cleaned 70 is greater than the distance between the first bottom surface 81 and the surface to be cleaned 70, that is, the second bottom surface 82 forms a sinking area of the bottom surface of the main body 10, so that the movable bracket 23 is arranged on the second bottom surface 82, which can increase the arrangement height of the movable bracket 23 relative to the surface 70 to be cleaned. At the same time, the first bottom surface 81 and the surface 70 to be cleaned still maintain a small distance, which can improve the obstacle-climbing capacity without increasing the overall height of the cleaning device 100. In some embodiments, the distance between the movable bracket 23 and the surface 70 to be cleaned is greater than half of the minimum distance between the bottom of the main body 10 and the surface 70 to be cleaned, that is, the distance between the movable bracket 23 and the surface 70 to be cleaned is greater than half of the minimum distance between the second bottom surface 82 and the surface 70 to be cleaned, please refer to the foregoing description, which will not be repeated herein.

Referring to FIG. 1, FIG. 21 and FIG. 22, further, the at least one drive wheel 60 includes two drive wheels 60. The second bottom surface 82 includes a middle area 83 and two recessed areas 84 arranged opposite to each other. The two recessed areas 84 are respectively arranged adjacent to the two drive wheels 60, and the two recessed areas 84 are connected by the middle area 83. The movable bracket 23 includes a flat part 85 and two connecting parts 86 arranged opposite to each other. The thickness of the flat part 85 is smaller than the thickness of the two connecting parts 86, and the flat part 85 is arranged in the middle area 83. The two connecting parts 86 are respectively arranged in the two recessed areas 84, and the cleaning assembly 30 is detachably connected to the two connecting parts 86.

In this embodiment, the middle area 83 and the two recessed areas 84 constitute the main surface of the second bottom surface 82. The two recessed areas 84 are respectively positioned on the left and right sides of the cleaning device 100, and the two recessed areas 84 are connected by the middle area 83. A height difference between a partial surface of the second bottom surface 82 that corresponds to the recessed area 84 and the first bottom surface 81 is the first height difference, and a height difference between the partial surface that the second bottom surface 82 corresponds to the middle area 83 and the second bottom surface 82 is the second height difference. The first height difference is greater than the second height difference, so that the distance between the partial surface of the second bottom surface 82 that corresponds to the recessed area 84 and the surface 70 to be cleaned is greater, which can provide larger arrangement space.

The flat part 85 of the movable bracket 23 is movably arranged at the middle area 83 of the second bottom surface 82. The flat part 85 of the movable bracket 23 may be provided with at least one sliding groove 232 or a guide slider 12. The movable bracket 23 has sliding fit with the at least one guide slider 12 at the middle area 83 through the at least one sliding groove 232. Alternatively, the movable bracket 23 has sliding fit with the at least one sliding groove 232 on the middle area 83 by means of the at least one guide slider 12, which can be referred to the foregoing description, and will not be repeated herein.

Compared to the flat part 85 of the movable bracket 23, the connecting part 86 of the movable bracket 23 has a larger thickness, which is convenient for providing a connecting structure such as a slot or a buckle on the connecting part 86 of the movable bracket 23. By arranging the two connecting parts 86 in the two recessed areas 84 respectively, the movable bracket 23 and the middle area 83 of the second bottom surface 82 can still maintain a small movement gap, so that the movable bracket 23 keeps a large distance from the surface 70 to be cleaned.

Referring to FIG. 1, FIG. 21 and FIG. 22, further, the movable bracket 23 is provided with a through hole 89. The main body 10 is provided with a fluid distributor 87 corresponding to the movable bracket 23, and the fluid distributor 87 is provided with a protrusion 88 which extends into the through hole 89. The fluid distributor 87 provides fluid for the cleaning assembly 30 or/and the surface 70 to be cleaned through the protrusion 88.

In this embodiment, the fluid distributor 87 is arranged at the bottom of the main body 10. The fluid distributor 87 and the movable bracket 23 are both arranged on the second bottom surface 82. The movable bracket 23 covers the fluid distributor 87, so that the position of the fluid distributor 87 will not affect the reciprocating movement of the movable bracket 23, which is beneficial to realize a larger reciprocating movement. The fluid distributor 87 can be connected to the peristaltic pump and the water tank 14 by means of pipes. The peristaltic pump can deliver the liquid in the water tank 14 to the fluid distributor 87, and then the fluid distributor 87 provides it for the cleaning assembly 30 or the surface 70 to be cleaned.

The above-mentioned structure is relatively compact, and occupies a small area of the bottom of the main body 10, which is beneficial to save space and minimize the cleaning device 100.

In some embodiments, the fluid distributor 87 is generally strip-shaped, and the fluid distributor 87 is provided with a distribution channel. The protrusion 88 is arranged on the outer surface of the fluid distributor 87, and the protrusion 88 is provided with water outlet holes communicating with the distribution channel. The water outlet holes of the plurality of protrusions 88 can uniformly output liquid with a larger volume flow.

In another embodiment, the fluid distributor 87 includes an input pipe and a plurality of branch pipes connected to the input pipe. The end of each branch pipe is provided with the protrusion 88, and the liquid of the input pipe can be divided to the plurality of pipes, and then is outputted to the outside through the protrusion 88 of each branch pipe.

Since the protrusion 88 extends into the through hole 89 of the movable bracket 23, which realizes a relative small distance between the protrusion 88 and the cleaning assembly 30, the protrusion 88 may extend to contact the cleaning assembly 30, or the protrusion 88 is spacing from the cleaning assembly The liquid output by the protrusion 88 can directly be provided to the cleaning assembly 30.

The number of the protrusions 88 can be two or three or four or more, and can be set according to actual needs. The number of the through holes 89 may be the same as the number of the protrusions 88. Of course, in other embodiments, a single through hole 89 can accommodate a plurality of protrusions 88 at the same time.

Referring to FIG. 1, FIG. 21 and FIG. 22, further, the movable bracket 23 can reciprocate relative to the main body 10 along a preset direction. The through hole 89 extends in a direction parallel to the movement direction of the movable bracket 23, so the extension length of the through hole 89 is greater than or equal to the movement stroke of the movable bracket 23. The predetermined direction is parallel to the advancing direction of the main body 10. The through hole 89 has a larger extension direction, which can prevent the protrusion 88 from interfering with the reciprocating movement of the movable bracket 23.

Referring to FIG. 1, FIG. 21 and FIG. 22, further, the movable bracket 23 is provided with a protruding part 233 beyond the supporting plate 31 in a direction parallel to the surface 70 to be cleaned. The flexible cleaning member 32 may be detachably connected to the protruding part 233 and the supporting plate 31, to lock the supporting plate 31 relative to the movable bracket 23.

In this embodiment, the movable bracket 23 is provided with a first side edge 92 adjacent to the two drive wheels 60, and the two connecting parts 86 of the movable bracket 23 are connected by the first side edge 92. Part of the first side edge 92 protrudes toward the middle position of the two drive wheels 60 to form the protruding part 233. The protruding direction of the protruding part 233 is substantially parallel to the reciprocating direction of the movable bracket 23. The supporting plate 31 has a second side edge 93 adjacent to the first side edge 92 and a third side edge 94 arranged opposite to the second side edge 93. The second side edge 93 extends substantially parallel to the length direction of the first side edge 92. The supporting plate 31 extends from the second side edge 93 to the third side edge 94 and covers the main part of the movable bracket 23. The protruding part 233 is arranged beyond the second side edge 93 of the supporting plate 31 in a direction parallel to the surface 70 to be cleaned, so that the protruding part 233 is exposed to the outside. The edge portion of the flexible cleaning member 32 can be detachably connected to the protruding part 233 by means of buckle, Velcro, sleeve, screw or magnet. The main part of the flexible cleaning member 32 can also be detachably connected to the side of the supporting plate 31 away from the movable bracket 23 by means of buckles, Velcro, socket, screw or magnets, so that the flexible cleaning member 32 can keep the movable bracket 23 and the supporting plate 31 being relatively locked, and the supporting plate 31, the flexible cleaning member 32 and the movable bracket 23 can form a solid whole. Under the action of the driving mechanism 80, the movable bracket 23, the supporting plate 31 and the flexible cleaning member 32 can move synchronously. When the movable bracket 23 drives the cleaning assembly 30 to reciprocate, it can not only prevent the supporting plate 31 from shaking violently relative to the movable bracket 23, but also prevent the cleaning assembly 30 from separating from the movable bracket 23 due to the impact of obstacles on the floor.

Figure 23:
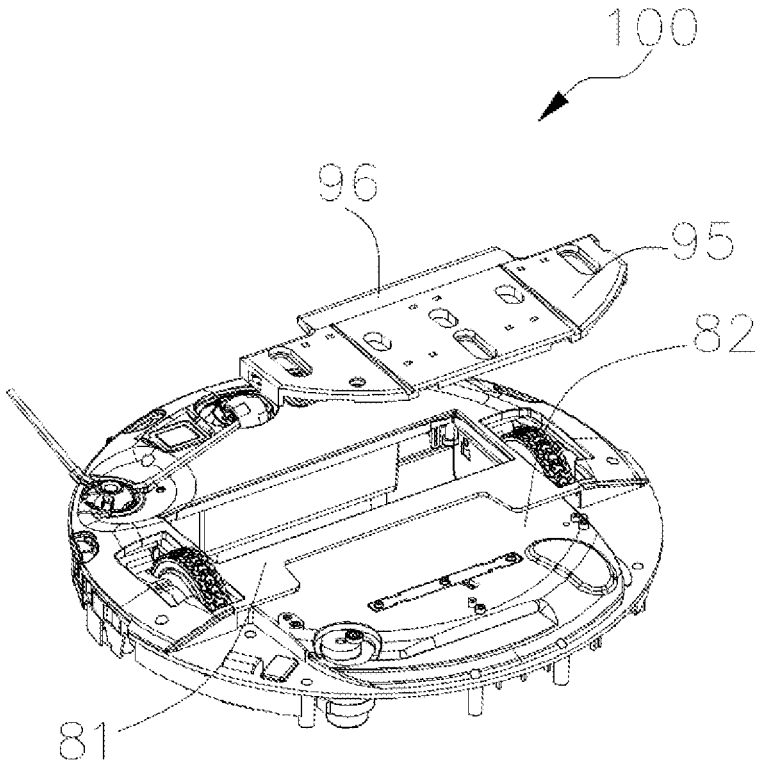
FIG. 23 is an eighth exploded view of some parts of the cleaning device provided by an embodiment of the present disclosure.

Referring to FIGS. 7 and 23 again, in some embodiments, the supporting plate 31 has a connecting surface 95 opposite to the second bottom surface 82, and the connecting surface 95 protrudes from the first bottom surface 81, that is, the distance between the connecting surface 95 and the surface 70 to be cleaned is smaller than the distance between the first bottom surface 81 and the surface 70 to be cleaned. The flexible cleaning member 32 may be attached to the connecting surface 95. The protruding part 233 also has an obstacle-climbing assistance surface 96 connected between the first bottom surface 81 and the connecting surface 95, and the obstacle-climbing assistance surface 96 extends to the first bottom surface 81 in an oblique direction. The obstacle-climbing assistance surface 96 may be an inclined surface or a curved surface, and the obstacle-climbing assistance surface 96 is capable of guiding the cleaning device 100 to smoothly climb across obstacles on the floor.

Finally, it should be noted that the above embodiments are only used to illustrate the technical solutions of the present disclosure, but not to limit the present disclosure. Under the idea of the present disclosure, the technical features of the above embodiments or different embodiments can also be combined, and the steps can be implemented in any order. There are many other variations of the different aspects of the present disclosure as described above, but they are not provided in details for the sake of brevity. Although the present disclosure has been described in detail with reference to the foregoing embodiments, those of ordinary skill in the art should understand that: they can still modify the technical solutions recorded in the foregoing embodiments, or equivalently replace some of the technical features; These modifications or replacements do not cause the essence of the corresponding technical solutions to deviate from the scope of the technical solutions of the embodiments of the present disclosure.

What is claimed is:

1. A cleaning device, comprising:

a main body;

at least one drive wheel arranged on the main body which is capable of moving on a surface to be cleaned by means of the at least one drive wheel;

a driving mechanism arranged on the main body, wherein the driving mechanism comprises a driving device mounted on the main body and at least one transmission member, wherein the driving device has a driving shaft extending toward the bottom of the main body;

a movable bracket movably connected to a bottom of the main body and connected to the driving shaft of the driving mechanism by the at least one transmission member, and configured to reciprocate in a direction parallel to the surface to be cleaned under a driving action of the driving mechanism; and a cleaning assembly detachably connected to the movable bracket, wherein the cleaning assembly comprises a flexible cleaning member detachably connected to the movable bracket;

wherein a movement gap is reserved between the movable bracket and the main body, wherein the cleaning device comprises at least one roller, and the at least one roller is rotatably connected to the movable bracket, and the at least one roller is partially positioned in the movement gap and rolls against a side of the main body close to the movable bracket; alternatively, the at least one roller is rotatably connected to the bottom of the main body, and the at least one roller is partially positioned in the movement gap and rolls against a side of the movable bracket close to the main body.

2. The cleaning device of claim 1, wherein the movable bracket is spaced from the surface to be cleaned, and a distance between the movable bracket and the surface to be cleaned is greater than a preset distance threshold.

3. The cleaning device of claim 2, wherein the cleaning assembly and the movable bracket are at least partially overlapped in a direction perpendicular to the surface to be cleaned.

4. The cleaning device of claim 3, wherein a thickness of the cleaning assembly is less than or equal to a distance between the movable bracket and the surface to be cleaned, and wherein the cleaning assembly is configured to contact the surface to be cleaned under an elastic force.

5. The cleaning device of claim 2, wherein the distance between the movable bracket and the surface to be cleaned is greater than half of the minimum distance between the bottom of the main body and the surface to be cleaned.

6. The cleaning device of claim 1, wherein the main body is provided with a first bottom surface on a side close to the surface to be cleaned and a second bottom surface adjacent to the first bottom surface, wherein there is a height difference between the first bottom surface and the second bottom surface, so that a distance between the first bottom surface and the surface to be cleaned is smaller than a distance between the second bottom surface and the surface to be cleaned, and wherein the at least one drive wheel protrudes from the first bottom surface, and the movable bracket is arranged on the second bottom surface.

7. The cleaning device of claim 6, wherein the at least one drive wheel comprises two drive wheels, wherein the second bottom surface comprises a flat area and two recessed areas arranged opposite to each other, the two recessed areas are respectively arranged adjacent to the two drive wheels respectively; and the two recessed areas are connected by the flat area, and wherein the movable bracket comprises a flat part and two connecting parts arranged opposite to each other, a thickness of the flat part is smaller than a thickness of each of the two connecting parts, the flat part is arranged on the flat area, the two connecting parts are respectively arranged in the two recessed areas, and the cleaning assembly is detachably connected to the two connecting parts.

8. The cleaning device of claim 1, wherein the movable bracket is provided with a through hole, the main body is provided with a fluid distributor corresponding to the movable bracket, the fluid distributor is provided with a protrusion, the protrusion extends into the through hole, and the fluid distributor provides fluid for the cleaning assembly or/and the surface to be cleaned through the protrusion.

9. The cleaning device of claim 8, wherein the movable bracket is capable of reciprocating relative to the main body along a preset direction, the through hole extends parallel to a movement direction of the movable bracket, and an extension length of the through hole is greater than or equal to a movement stroke of the movable bracket, wherein the preset direction is parallel to an advancing direction of the main body.

10. The cleaning device of claim 1, wherein the movable bracket is provided with at least one sliding groove, the bottom of the main body is protrudingly provided with at least one guide slider, and the at least one guide slider has sliding fit with the at least one sliding groove respectively.

11. The cleaning device of claim 1, wherein the cleaning assembly further comprises a supporting plate, the supporting plate is detachably connected to the movable bracket, the supporting plate is superimposed on a side of the movable bracket away from the main body, and the flexible cleaning member is detachably connected to a side of the supporting plate away from the movable bracket.

12. The cleaning device of claim 11, wherein the supporting plate is provided with two engaging parts arranged opposite to each other, and the two engaging parts are respectively connected to two ends of the movable bracket.

13. The cleaning device of claim 11, wherein the movable bracket is provided with a protruding part beyond the supporting plate in a direction parallel to the surface to be cleaned, and wherein the flexible cleaning member is detachably connected to the protruding part and the supporting plate, so that the supporting plate is locked relative to the movable bracket.

14. The cleaning device of claim 1, wherein the main body comprises a chassis and a water tank connected to the chassis, the chassis carries the water tank, and the driving mechanism is arranged on the chassis or the water tank.

15. The cleaning device of claim 2, wherein the distance between the movable bracket and the surface to be cleaned is 4~8 mm.

16. The cleaning device of claim 8, wherein the protrusion is provided with water outlet holes which can uniformly output liquid with a larger volume flow.

17. The cleaning device of claim 1, wherein the at least one roller comprises a plurality of first rollers, wherein the plurality of first rollers roll against the bottom surface of the main body and support for the movable bracket at a first preset position, so that the movable bracket maintains a movement gap with the bottom of the main body.

18. The cleaning device of claim 17, wherein the at least one roller further comprises a plurality of second rollers rotatably connected to the movable bracket, wherein the plurality of second rollers roll against the bottom surface of the main body and support for the movable bracket at a second preset position, so that a movement gap is provided between the movable bracket maintains and the bottom of the main body in the front and rear directions.

19. The cleaning device of claim 13, wherein the protruding part has an obstacle-climbing assistance surface extending between the main body and the supporting plate, and the obstacle-climbing assistance surface is an inclined surface or a curved surface.

* * * * *